US007871157B2

(12) United States Patent
Koike et al.

(10) Patent No.: US 7,871,157 B2
(45) Date of Patent: Jan. 18, 2011

(54) LIQUID-JET APPARATUS LIQUID INTRODUCING NEEDLE WITH AIR INTAKE SUPPRESSION

(75) Inventors: Yasunori Koike, Matsumoto (JP); Katsuhiro Okubo, Azumino (JP); Noriaki Okazawa, Shiojiri (JP); Keiichi Kumagai, Suwa (JP); Takeshi Fujishiro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 576 days.

(21) Appl. No.: 11/943,947

(22) Filed: Nov. 21, 2007

(65) Prior Publication Data

US 2008/0117270 A1 May 22, 2008

(30) Foreign Application Priority Data

Nov. 22, 2006 (JP) ..... 2006-316095
Jan. 18, 2007 (JP) ..... 2007-009582

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS 6,367,920 B1 * 4/2002 Kanai et al. ..... 347/86
6,554,412 B1 4/2003 Seino et al.
6,786,581 B1 * 9/2004 Shinada et al. ..... 347/86
7,325,913 B2 * 2/2008 Sasaki et al. ..... 347/86
7,328,987 B2 * 2/2008 Katayama et al. ..... 347/86
7,334,888 B2 * 2/2008 Sasaki et al. ..... 347/86
7,393,088 B2 * 7/2008 Sasaki ..... 347/84
2002/0075367 A1 * 6/2002 Chiu ..... 347/86

FOREIGN PATENT DOCUMENTS

| | | |
|---|---|---|
| JP | 11-005314 | 1/1999 |
| JP | 11-207988 | 8/1999 |
| JP | 2001-199082 | 7/2001 |
| JP | 2006-069168 | 3/2006 |
| JP | 2006-142816 | 6/2006 |
| KR | 10-2006-0024329 | 3/2006 |

* cited by examiner

*Primary Examiner*—An H Do
(74) *Attorney, Agent, or Firm*—Workman Nydegger

(57) ABSTRACT

Provided is a liquid-jet apparatus which can suppress liquid consumption by preventing air that can turn into bubbles from entering a liquid introducing columnar body in replacement of a liquid storage member and thus reducing a frequency of execution of a cleaning operation for discharging the bubbles inside a liquid passage. An ink introducing needle in a printer includes: a needle-like protrusion having a tapered portion whose diameter is gradually increased toward its base from its tip; and a straight portion formed linearly and continuously from the tapered portion. In the tapered portion of the needle-like protrusion in the ink introducing needle, groove portions extending to an edge portion of the tapered portion are provided.

6 Claims, 20 Drawing Sheets

LIQUID-JET APPARATUS LIQUID INTRODUCING NEEDLE WITH AIR INTAKE SUPPRESSION

The entire disclosures of Japanese Patent Applications Nos. 2006-316095 filed Nov. 22, 2006 and 2007-9582 filed Jan. 18, 2007 are expressly incorporated by reference herein.

BACKGROUND

1. Technical Field

The present invention relates to a liquid-jet apparatus such as an ink-jet recording apparatus, and more particularly relates to a liquid-jet apparatus which ejects a liquid stored in a liquid storage member from nozzle orifices in a liquid-jet head by introducing the liquid into the liquid-jet head through liquid introducing needles.

2. Related Art

There is a liquid-jet apparatus which includes a liquid-jet head capable of ejecting a liquid, and which ejects various kinds of liquid from the liquid-jet head. Representative examples of such a liquid-jet apparatus include, for example, an image recording apparatus such as an ink-jet printer which performs recording by ejecting ink droplets and having the droplets land on recording paper or the like as an ejection target (recording medium). Moreover, in recent years, the liquid-jet apparatus has been applied not only for the image recording apparatus but also for various types of manufacturing equipment. For example, in display manufacturing equipment for a liquid crystal display, a plasma display, an organic EL (Electro Luminescence) display, a FED (Field Emission Display) and the like, the liquid-jet apparatus is used for ejecting various liquid materials such as color materials and electrodes onto a pixel forming region, an electrode forming region and the like.

As the liquid-jet apparatus of this type, there have been developed a wide variety of apparatuses using a cartridge-type liquid storage member that is easily distributed and handled. For example, regarding the ink-jet printer (hereinafter, simply referred to as a printer), those using ink cartridges filled with liquid ink have been widely used. In this configuration, the ink cartridge is loaded on a cartridge loading section and ink introducing needles (liquid introducing columnar bodies) are inserted into the ink cartridge. Thus, the ink in the ink cartridge is introduced into a recording head that is a kind of liquid-jet head through ink introducing ports (liquid introducing ports) which are drilled in tips (tapered portions) of the ink introducing needles. Moreover, generally, in such an ink cartridge, for preventing leakage and evaporation of the ink to the outside, opening portions of needle insertion slots (ink outlets) provided in a bottom portion thereof are sealed with a thin breakable resin film (sealing film) made of PP (polypropylene) or the like. Moreover, when the ink cartridge is loaded into the printer, the ink introducing needles break the sealing film to be inserted into the needle insertion slots.

In the configuration using the ink cartridge as described above, an ideal state is that ink passages (liquid passages) from the ink introducing needles to nozzle orifices in the recording head are filled with the ink. However, bubbles may enter the ink passages during replacement of the ink cartridge or the like. Moreover, it is difficult to completely prevent the bubbles from entering thereinto. This is because of the following reason. Specifically, in the case of loading an unused ink cartridge, ink introducing needles are pushed into needle insertion slots in the ink cartridge. Thus, a sealing film that seals the needle insertion slots is broken by tips of the ink introducing needles. In this breaking of the sealing film, the film is flexed and temporarily adheres to the tips of the ink introducing needles. Accordingly, air compressed between the sealing film and the ink introducing needles in this adhesion state enters the ink introducing needles from ink introducing ports and becomes bubbles. Thereafter, the bubbles that have entered ink passages gradually grow in size and some of the overgrown bubbles are moved toward a pressure chamber by a flow of the ink. As a result, there may arise problems such as pressure loss due to absorption of pressure fluctuations in an ejection operation by the bubbles and insufficient supply of ink due to blocking of the passages by the bubbles.

For the purpose of preventing such problems caused by the bubbles, the following invention has been proposed. For example, according to JP-A-2006-069168, a plurality of ribs are provided in an enlarged diameter portion formed at a base of an ink introducing needle to protrude from an inner peripheral surface of the enlarged diameter portion toward its center. Moreover, bubble chambers are partitioned by both ribs adjacent to each other in the peripheral direction. By moving bubbles in an upper part (upstream side) of a filter into the bubble chambers with a flow-down force of ink passing inside the ink introducing needle, a contact area of the bubbles with the filter is increased. Thus, efficiency of discharging the bubbles is improved and the bubbles are discharged to the outside of a recording head. JP-A-2006-069168 is an example of related art.

However, the invention disclosed in JP-A-2006-069168 is for discharging the bubbles that have entered the ink introducing needle rather than preventing the bubbles from entering the ink introducing needle. Thus, in order to discharge the bubbles inside the ink introducing needle, it is necessary to frequently perform a cleaning operation for generating an ink flow having a flow rate several times higher than that in a recording operation. As a result, there is a problem of wasteful consumption of ink.

SUMMARY

An advantage of some aspects of the invention is to provide a liquid-jet apparatus which can suppress liquid consumption by preventing air to turn into bubbles from entering a liquid introducing columnar body in replacement of a liquid storage member and thus reducing a frequency of execution of a cleaning operation for discharging the bubbles inside a liquid passage.

An aspect of the invention to achieve the advantage is a liquid-jet apparatus including: a liquid storage member in which a liquid is stored, and which has an outlet to be an outlet of the liquid; a liquid-storage-member mounting part on which the liquid storage member is detachably mounted; a liquid introducing columnar body which introduces the liquid inside the liquid storage member into a liquid passage therein from liquid introducing ports in a state of being inserted into the outlet of the liquid storage member mounted; and a liquid-jet head which can eject the liquid, which is introduced from the liquid introducing columnar body, from nozzle orifices in accordance with the operation of a pressure generator. The liquid introducing columnar body includes a tip surface facing the outlet and a straight portion formed continuously with the tip surface, and groove portions are provided in the tip surface of the liquid introducing columnar body.

According to the aspect of the invention, the groove portions are provided in the tip surface of the liquid introducing columnar body, the tip surface facing a sealing member. Thus, even if air is compressed between the sealing member and the tip surface of the liquid introducing columnar body when the liquid storage member is mounted on the liquid-storage-member mounting part, the air is allowed to flow out to the outside of the liquid introducing columnar body through the groove portions. Therefore, in the mounting of the liquid storage member, the air to turn into bubbles can be prevented from entering the liquid introducing columnar body. Thus, compared with the conventional case, a frequency of execution of a cleaning operation for discharging the bubbles flowing into the liquid introducing columnar body to the outside can be reduced. As a result, ink consumption associated with the cleaning operation can be reduced.

Here, it is preferable that the groove portions penetrate a boundary between the tip surface and the straight portion. In this case, the groove portions penetrate the boundary between the tip surface of the liquid introducing columnar body and the straight portion. Thus, in the mounting of the liquid storage member, even if the sealing member adheres to the entire tip surface of the liquid introducing columnar body, the air between the sealing member and the tip surface of the liquid introducing columnar body can be surely allowed to flow out to the outside through the groove portions.

Moreover, it is preferable that the groove portions continuously extend to the middle of the straight portion from the tip surface. In this case, the groove portions continuously extend to the straight portion from the tip surface of the liquid introducing columnar body. Thus, in the mounting of the liquid storage member, even if the sealing member adheres to the entire tip surface of the liquid introducing columnar body and the straight portion, the air between the sealing member and the tip surface of the liquid introducing columnar body can be surely allowed to flow out to the outside through the groove portions extending to the straight portion.

Moreover, it is preferable that the liquid introducing ports are drilled to have openings inside the corresponding groove portions. In this case, the liquid introducing ports are drilled to have openings inside the groove portions. Thus, in the mounting of the liquid storage member, the liquid introducing ports never directly adhere to the sealing member. Therefore, the air between the sealing member and the liquid introducing columnar body is made less likely to be pushed directly into the liquid introducing ports. Thus, in the mounting of the liquid storage member, the air can be more surely prevented from entering the liquid introducing columnar body from the liquid introducing ports.

Moreover, it is preferable that liquid introducing columnar body includes a needle-like protrusion having a tapered portion whose diameter is gradually increased toward its base from its tip, and the tip surface is a tapered surface of the needle-like protrusion. In this case, the tip of the liquid introducing columnar body is the needle-like protrusion having the tapered portion. Thus, it is made easy for the liquid introducing columnar body to break the sealing member.

Moreover, it is preferable that the outlet of the liquid storage member is sealed by a sealing member to be broken along one direction, and the groove portions in the liquid introducing columnar body are formed along the direction in which the sealing member is to be broken. In this case, an area of the groove portions covered with the sealing member can be reduced. Thus, more air between the outlet of the liquid storage member and the sealing member blocking the outlet can be discharged to the outside.

Furthermore, another aspect of the invention is a liquid-jet apparatus including: a liquid storage member in which a liquid is stored, and which has an outlet to be an outlet of the liquid; a liquid-storage-member mounting part on which the liquid storage member is detachably mounted; a liquid introducing columnar body which introduces the liquid inside the liquid storage member into a liquid passage therein from liquid introducing ports in a state of being inserted into the outlet of the liquid storage member mounted; and a liquid-jet head which can eject the liquid, which is introduced from the liquid introducing columnar body, from nozzle orifices in accordance with the operation of a pressure generator. The outlet of the liquid storage member is sealed by a sealing member to be broken along one direction. Moreover, a protrusion is formed on a tip surface of the liquid introducing columnar body, the tip surface facing the sealing member, and the protrusion has its longitudinal direction intersecting with the direction in which the sealing member is to be broken.

According to the aspect of the invention, an area of an opening portion of the sealing member covered with the protrusion can be reduced. Thus, more air between the outlet of the liquid storage member and the sealing member blocking the outlet can be discharged to the outside. Therefore, in the mounting of the liquid storage member, the air to turn into bubbles can be prevented from entering the liquid introducing columnar body. Thus, compared with the conventional case, a frequency of execution of a cleaning operation for discharging the bubbles flowing into the liquid introducing columnar body to the outside can be reduced. As a result, ink consumption associated with the cleaning operation can be reduced.

Here, it is preferable that the liquid introducing columnar body has a shoulder portion continuous with a base of the protrusion, and the liquid introducing ports are drilled in the shoulder portion. In this case, the liquid introducing ports never directly adhere to the sealing member. Therefore, air between the sealing member and an outer surface of the shoulder portion in the liquid introducing columnar body is made less likely to be pushed directly into the liquid introducing ports. Thus, in the mounting of the liquid storage member, the air can be further prevented from entering the liquid introducing columnar body from the liquid introducing ports.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

With reference to the accompanying drawings, embodiments of the present invention will be described below. Note that, while various limitations are imposed on the embodiments described below as preferable concrete examples of the invention, the scope of the invention is not limited to those embodiments unless otherwise described to limit the invention in the following description. Moreover, the embodiments of the invention will be described by taking, as an example, an ink-jet recording apparatus (hereinafter, referred to as a printer) that is a typical liquid-jet apparatus.

Figure 1:
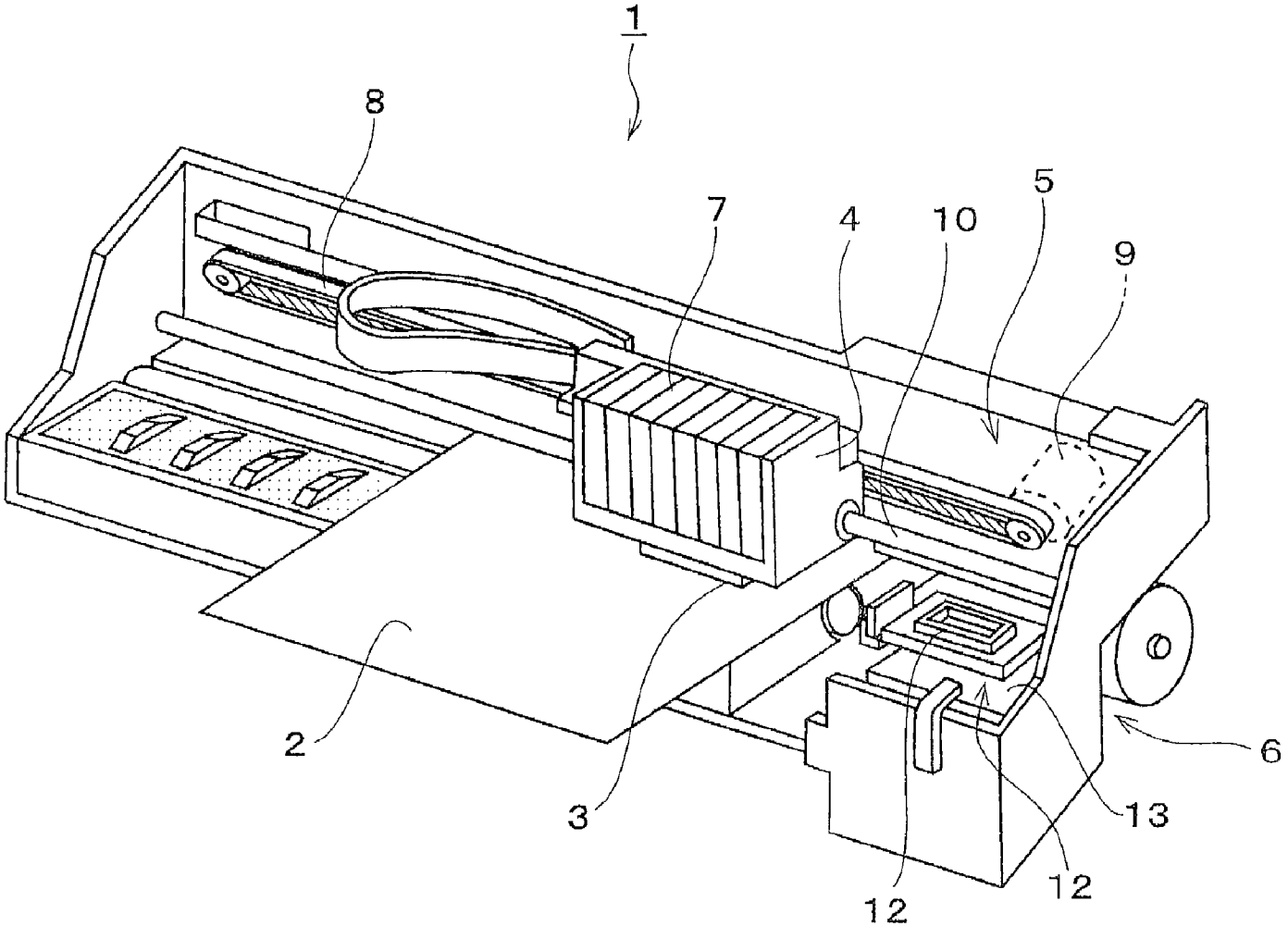
FIG. 1 is a perspective view of a printer.
Figure 2:
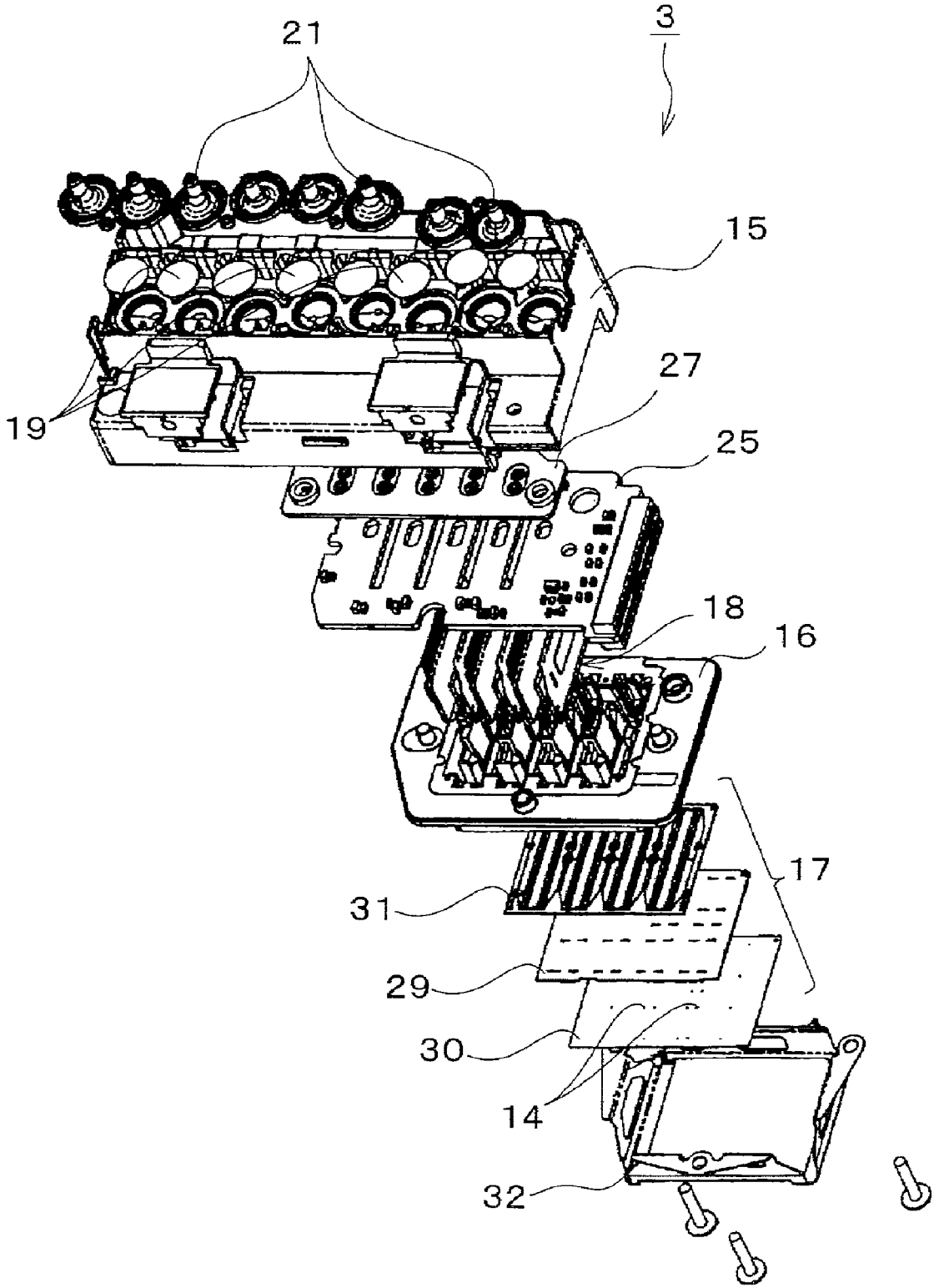
FIG. 2 is an exploded perspective view of a recording head.
Figure 3:
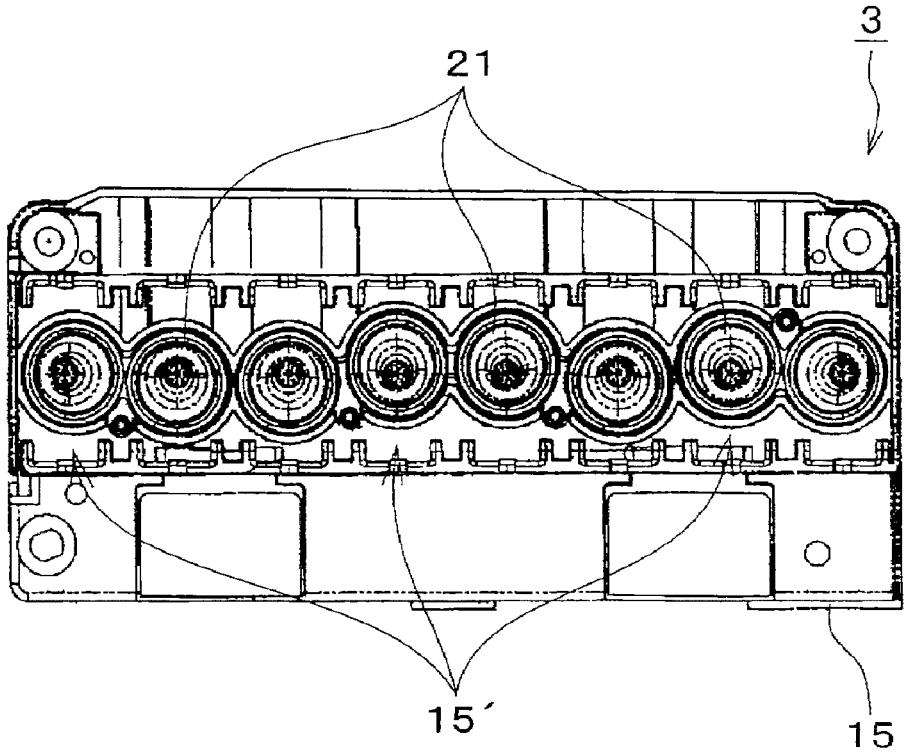
FIG. 3 is a plan view of the recording head.
Figure 4:
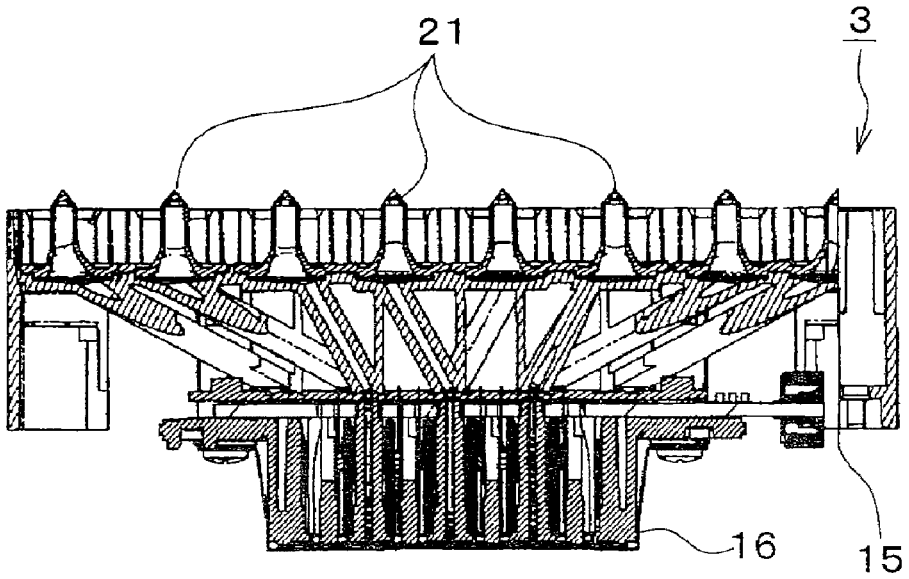
FIG. 4 is a cross-sectional view of the recording head.
Figure 5:
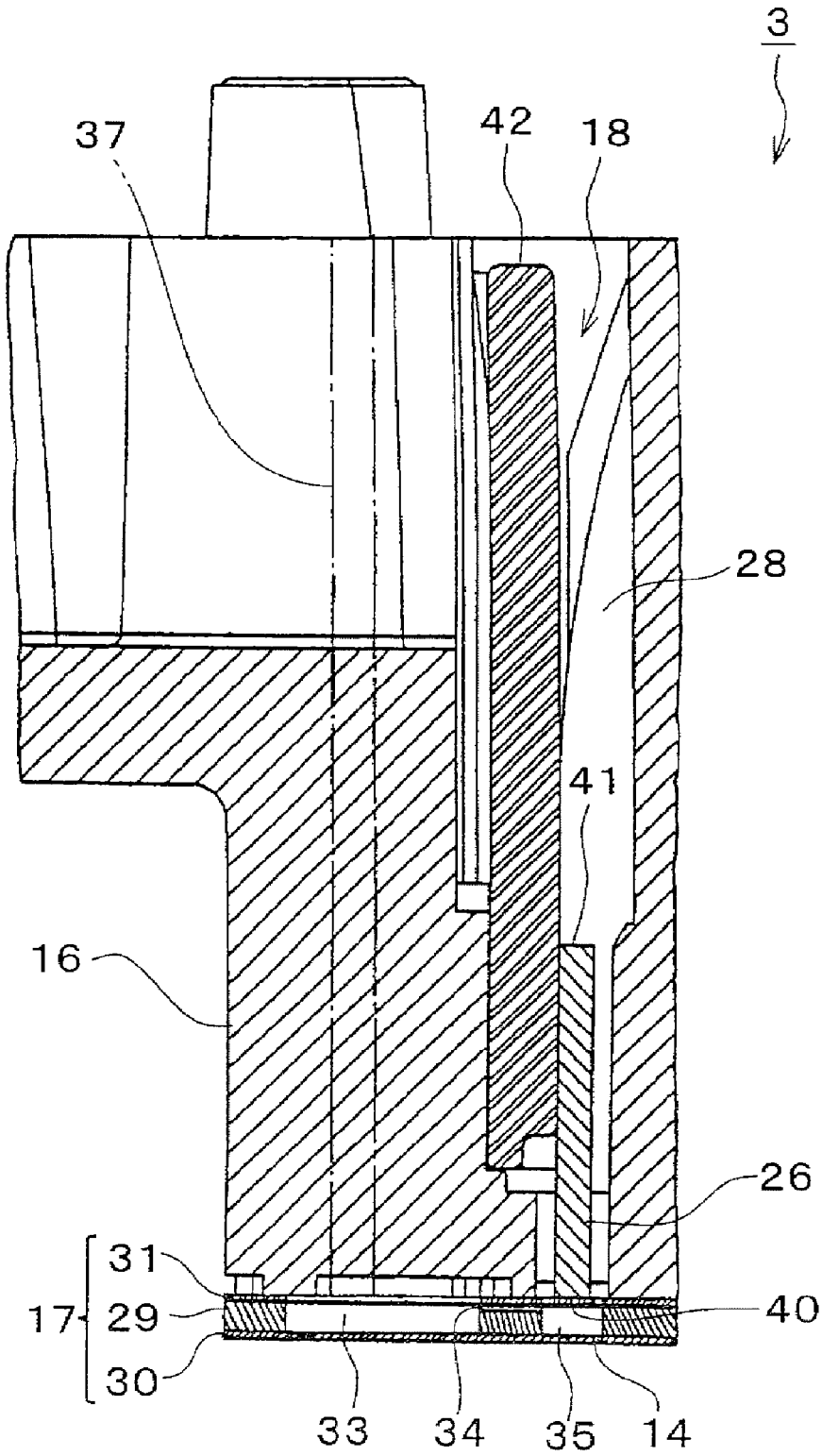
FIG. 5 is a cross-sectional view of a main part of the recording head.

Here, FIG. 1 is a perspective view of the printer typified by the ink-jet recording apparatus. FIG. 2 is an exploded perspective view of a recording head. FIG. 3 is a plan view of the recording head. FIG. 4 is a cross-sectional view of the recording head. FIG. 5 is a cross-sectional view of a main part of the recording head.

First, with reference to FIG. 1, description will be given of a schematic configuration of the ink-jet recording apparatus (a kind of the liquid-jet apparatus and hereinafter referred to as a printer) which has the recording head mounted thereon. A printer 1 shown in FIG. 1 performs recording of images and the like by ejecting ink in a form of ink droplets onto a surface of a recording medium (ejection target) 2 such as recording paper. The printer 1 includes: a recording head 3; a carriage 4 to which the recording head 3 is attached; a carriage moving mechanism 5 which moves the carriage 4 back and forth in a main scanning direction; a paper feed mechanism 6 which transfers the recording medium 2 in a sub-scanning direction (direction perpendicular to the main scanning direction); and the like. Here, the ink is a kind of liquid in the invention and stored in an ink cartridge 7 (a kind of liquid storage member). The ink cartridge 7 is detachably loaded on the carriage 4 having the recording head 3 attached thereto.

The carriage moving mechanism 5 includes a timing belt 8. This timing belt 8 is driven by a pulse motor 9 such as a DC motor. Therefore, when the pulse motor 9 is operated, the carriage 4 is guided by a guide rod 10 installed in the printer 1 and moved back and forth in the main scanning direction (width direction of the recording medium 2).

At a home position that is a non-recording area in the printer 1, a capping mechanism 12 is provided. The capping mechanism 12 has a tray-shaped cap member 12' which can come into contact with a nozzle forming surface of the recording head 3. In the capping mechanism 12, a space inside the cap member 12' functions as a sealing hollow part and the cap member 12' is configured to be able to adhere to the nozzle forming surface in a state of allowing a nozzle orifice 14 (see FIG. 5) in the recording head 3 to face the inside of the sealing hollow part. Moreover, a pump unit 13 is connected to the capping mechanism 12 and a pressure in the sealing hollow part can be reduced by operating the pump unit 13. When the pressure in the sealing hollow part (sealed space) is reduced by operating the pump unit 13 in the state where the cap member 12' adheres to the nozzle forming surface, the ink and bubbles in the recording head 3 are suctioned from the nozzle orifice 14 and discharged into the sealing hollow part of the cap member 12'. Specifically, the capping mechanism 12 is configured to perform a cleaning operation for forcibly suctioning and discharging the ink and bubbles in the recording head 3 (in ink passages). In this cleaning operation, ink flows having a flow rate several times higher than that in a normal recording operation are generated in the ink passages (ink introducing paths 38) by operating the pump unit 13 in the state where the cap member 12' is allowed to adhere to the nozzle forming surface. Thereafter, bubbles floating inside an increased diameter portion 52 to be described later are put on the ink flows and allowed to pass toward a downstream side while being pressed against upper surfaces (an upstream side) of filters 19. Thus, the bubbles are discharged to the outside of the recording head 3 from the nozzle orifices 14 through a series of ink passages on the downstream side of the filters 19.

Next, a configuration of the recording head 3 will be described. The recording head 3 shown in FIG. 2 generally includes an introducing needle unit 15, a head case 16, a passage unit 17, a vibrator unit 18 and the like.

The introducing needle unit 15 is made of, for example, synthetic resin and, as shown in FIG. 3, a plurality of cartridge mounting parts 15' (a kind of liquid-storage-member mounting part) are provided on an upper surface thereof. In the respective cartridge mounting parts 15', ink introducing needles 21 (corresponding to liquid introducing columnar bodies in the invention) are attached to have their tips protrude upward in a state where the filters 19 for filtering the ink in the ink passages are interposed therebetween. Moreover, on those cartridge mounting parts 15', the ink cartridge 7 having various kinds of ink stored therein is mounted. When the ink cartridge 7 is mounted on the cartridge mounting parts 15', the ink introducing needles 21 are inserted into the ink cartridge 7. Thus, an ink storage space inside the ink cartridge 7 and the ink passages inside the recording head 3 are communicated with each other through ink introducing ports 24 (see FIGS. 7A and 7B) which are drilled in tips of the ink introducing needles 21. Accordingly, the ink stored in the ink cartridge 7 is introduced into the recording head 3 through the ink introducing ports 24. Note that the ink cartridge 7 and the ink introducing needles 21 will be described in detail later.

As shown in FIG. 2, a circuit board 25 is attached between a lower surface of the introducing needle unit 15, the lower surface being a side opposite to the cartridge mounting parts 15', and an upper surface of the head case 16. The circuit board 25 includes, for example: a circuit pattern for supplying a driving signal to a piezoelectric vibrator 26 (see FIG. 5); a connector for connection with the printer 1 main body; and the like. Moreover, the circuit board 25 is attached to the introducing needle unit 15 with a sheet member 27 interposed therebetween, which functions as a packing.

The head case 16 is a hollow box-shaped member for housing the vibrator unit 18 having the piezoelectric vibrator 26. Inside the head case 16, a housing hollow part 28 (see FIG. 5) is formed, which can house the vibrator unit 18 therein. The vibrator unit 18 is housed in the housing hollow part 28 and fixed to an inner peripheral surface of the housing hollow part 28 with an adhesive agent or the like. Moreover, the passage unit 17 is fixed with an adhesive agent or the like to a front end surface of the head case 16, which is opposite to a surface for mounting the introducing needle unit 15. The passage unit 17 is prepared by bonding and integrating, with an adhesive agent or the like, a nozzle plate 30 and a vibration plate 31 while sandwiching a passage-forming substrate 29 therebetween in a laminated state where the nozzle plate 30 is disposed on one side of the passage-forming substrate 29 and the vibration plate 31 is disposed on the other side thereof that is opposite to the nozzle plate 30.

The nozzle plate 30 is a member made of, for example, a stainless-steel thin plate. In this nozzle plate 30, minute nozzle orifices 14 are formed in a row with a pitch corresponding to dot formation density of the printer 1. A head cover 32 is made of, for example, a thin metal plate member and is attached to a front end portion of the head case 16 to surround a peripheral portion of the nozzle plate 30 from outside thereof. The head cover 32 has a function of protecting the passage unit 17 and the front end portion of the head case 16 and also preventing charging of the nozzle plate 30.

The passage-forming substrate 29 bonded to the nozzle plate 30 is, as shown in FIG. 5, a plate-like member in which a plurality of common ink chambers 33, pressure chambers 35 and ink supply ports 34 are formed to correspond to the respective nozzle orifices 14 in a state of being separated with compartment walls. Specifically, the common ink chambers 33 and the pressure chambers 35 are hollow parts, and the ink supply ports 34 are communicating parts which communicate those chambers with each other. The passage-forming substrate 29 is prepared by etching a silicon wafer, for example. Each of the pressure chambers 35 is formed to be a long and narrow chamber extending in a direction perpendicular to an arrangement direction of the nozzle orifices 14 (a nozzle array direction). Moreover, each of the common ink chambers 33 is a chamber which is communicated with the ink introducing path 38 (a kind of liquid passage, see FIG. 7B) in the ink introducing needle 21 through a head passage 37 (a kind of liquid passage) penetrating the head case 16 in its height direction and into which the ink stored in the ink cartridge 7 is introduced. The ink introduced into the common ink chambers 33 is supplied to the pressure chambers 35 through the respective ink supply ports 34.

The vibration plate 31 bonded to the other side of the passage-forming substrate 29, the other side being opposite to the nozzle plate 30, is a composite plate material having a double-layered structure in which an elastic film is laminated on a supporting plate made of metal such as stainless steel. In a portion of the vibration plate 31 corresponding to the pressure chamber 35, an island part 40 for bonding a tip of a free end of the piezoelectric vibrator 26 is formed. This island part functions as a diaphragm part. Moreover, the vibration plate 31 seals an opening surface on one side of a hollow part to be the common ink chamber 33 and also functions as a compliance part. In the portion that functions as the compliance part, only the elastic film is formed.

As shown in FIG. 5, the vibrator unit 18 includes: a piezoelectric vibrator group 41 as pressure generation means; a fixed plate 42 to which the piezoelectric vibrator group 41 is bonded; a flexible cable (not shown) for supplying the driving signal from the circuit board 25 to the piezoelectric vibrator group 41; and the like. The piezoelectric vibrator group 41 in this embodiment includes a plurality of piezoelectric vibrators 26 which are arranged in a comb-teeth pattern. Each of the piezoelectric vibrators 26 has its fixed end bonded onto the fixed plate 42 and its free end protruding outside a front end surface of the fixed plate 42. Specifically, the piezoelectric vibrator 26 is attached onto the fixed plate 42 in a so-called cantilever state. Moreover, the fixed plate 42 supporting the piezoelectric vibrators 26 is made of stainless steel having a thickness of about 1 mm, for example. Note that, as the pressure generation means, an electrostatic actuator, a magnetostrictor, a heater element and the like can be used other than the piezoelectric vibrator.

In the recording head 3, when the piezoelectric vibrator 26 extends or is contracted in a longitudinal direction of the element, the island part 40 is moved in a direction approaching or separating from the pressure chamber 35. Thus, a volume of the pressure chamber 35 is changed to cause a pressure fluctuation in the ink inside the pressure chamber 35. By this pressure fluctuation, ink droplets (a kind of liquid droplets) are ejected from the nozzle orifices 14.

Figure 6:
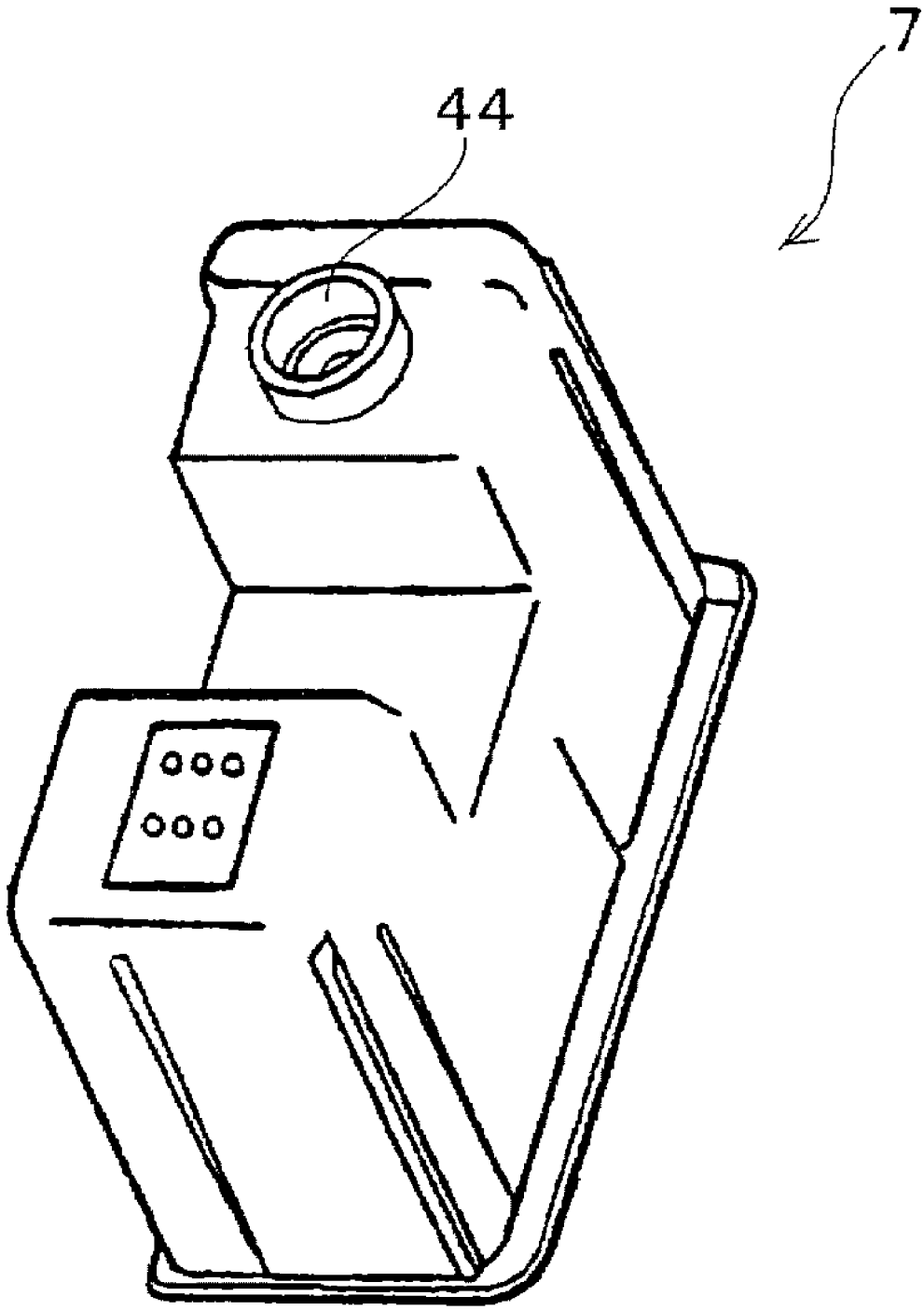
FIG. 6 is a perspective view of an ink cartridge.
Figure 7A:
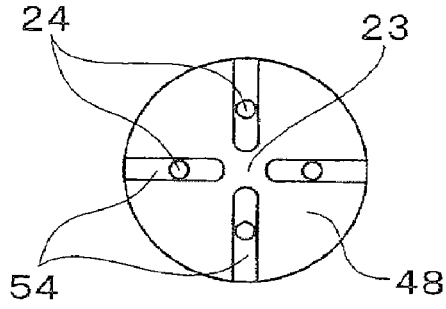
FIG. 7A is a plan view.
Figure 7B:
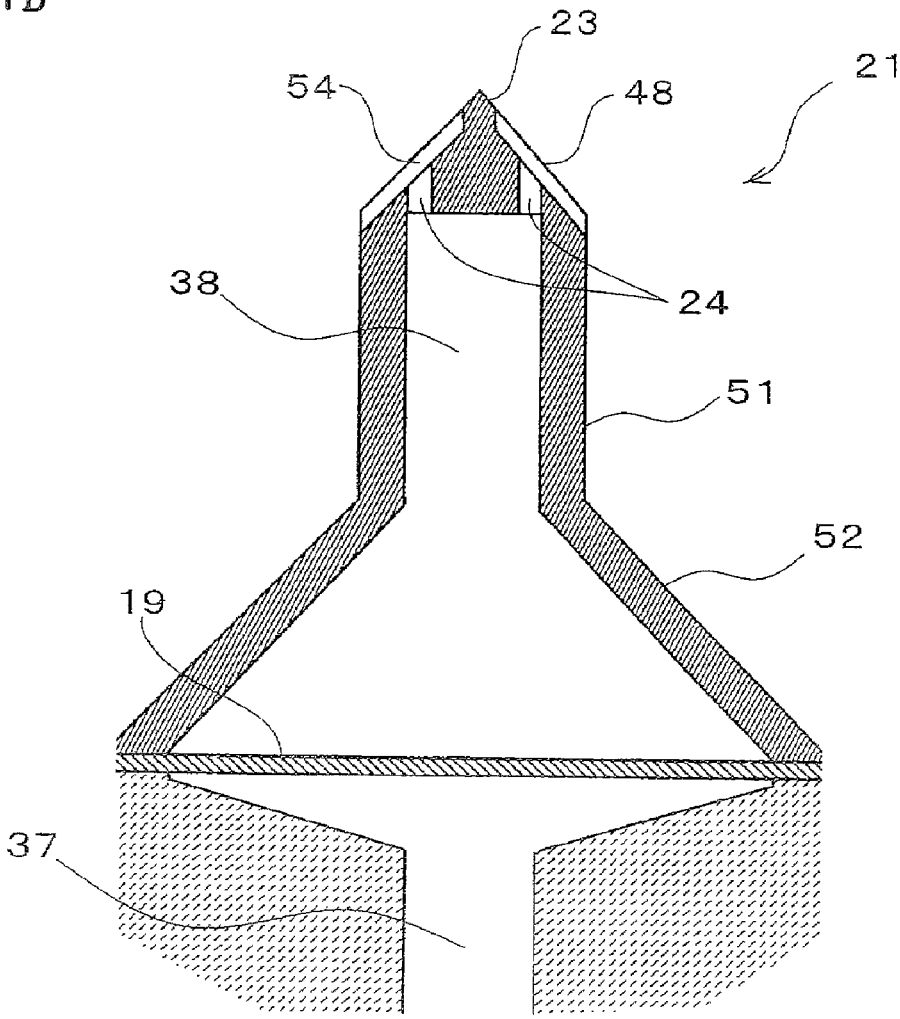
FIG. 7B is a cross-sectional view showing one of ink introducing needles.

Next, the ink cartridge 7 and the ink introducing needles 21 will be described. FIG. 6 is a perspective view showing a configuration of the ink cartridge. FIGS. 7A and 7B are views showing a configuration of each of the ink introducing needles. FIG. 7A is a plan view of the ink introducing needle and FIG. 7B is a cross-sectional view of the ink introducing needle, taken along the longitudinal direction thereof.

The ink cartridge 7 is a member that functions as a kind of the liquid storage member of the invention, and in which ink to be supplied to the recording head 3 is stored. The printer 1 of this embodiment is configured to be able to eject eight kinds of ink, to be more specific, eight colors of ink, including yellow, magenta, cyan, matte black, photo black, red, blue and gloss optimizer (clear). On the recording head 3, eight ink cartridges 7 in total, in which the respective colors of ink is individually stored, are loaded.

As shown in FIG. 6, in a bottom surface of each of the ink cartridges 7, a needle insertion slot 44 that is an ink outlet is provided, into which the ink introducing needle 21 is to be inserted. This needle insertion slot 44 is formed to be a short cylindrical part from the bottom surface of the ink cartridge 7 toward the outside. An O-ring 45 made of an elastic material such as rubber is provided in a portion closer to a front opening on an inner circumferential surface of the cylindrical part. Moreover, a sealing film 46 that is a kind of sealing member is attached to the front opening for sealing. This sealing film 46 is a seal for preventing leakage and evaporation of the ink stored in the ink cartridge 7 that is unused. Moreover, as the sealing film, for example, a thin (a thickness of, for example, about 39 μm) breakable resin film such as PP (polypropylene) is preferably used. As described later, the sealing film is broken by the ink introducing needle 21 in loading of the ink cartridge 7. Meanwhile, the O-ring 45 is a sealing member for preventing the ink stored in the ink cartridge 7 from leaking to the outside by adhering to an outer peripheral surface of a straight portion 51 of the ink introducing needle 21 in a liquid-tight state after the ink cartridge 7 is loaded. Note that the sealing member is not limited to the O-ring 45 but may have any configuration as long as a sealing function is achieved.

The ink introducing needle 21 that is an example of the liquid introducing columnar body to be inserted into the ink cartridge 7 is, as shown in FIG. 7B, a hollow needle having the ink introducing path 38 (a kind of liquid passage) formed therein. Moreover, the ink introducing needle 21 consists of: a needle-like protrusion 23 having a tapered portion 48 whose diameter is gradually increased toward its base from its tip; the cylindrical straight portion 51 formed continuously with the needle-like protrusion 23; and the skirt-shaped increased diameter portion 52 having a diameter being gradually increased toward a downstream side of the straight portion 51 from a lower end thereof. At the tip of the tapered portion 48, the ink introducing ports 24 (a kind of liquid introducing port in the invention) are provided, which communicate an external space with the ink introducing path 38. Moreover, the ink introducing needle 21 is mounted on the introducing needle unit 15 by ultrasonic welding, for example, in a state where an opening at a lower end of the increased diameter portion 52 is allowed to face the filter 19 (see FIGS. 3 and 4). Thus, the ink introducing path 38 in the ink introducing needle 21 and the head passage 37 in the head case 16 are communicated with each other in a liquid-tight state. Accordingly, an area of the opening at the lower end of the increased diameter portion 52 becomes an effective filtration area of the filter 19 disposed immediately therebelow. Note that the ink introducing path 38 and the head passage 37 function as the liquid passages in the invention.

The straight portion 51 is a hollow cylindrical member to be inserted into the ink cartridge 7. Moreover, the straight portion is configured to make it easy for the needle-like protrusion 23 having a cone shape to break the sealing film 46 and to be inserted into the needle insertion slot 44 when the ink cartridge 7 is loaded. From positions off the tip of the needle-like protrusion 23, to be more specific, positions slightly lower than the tip of the needle-like protrusion 23 along the slope toward a boundary between the tapered portion 48 and the straight portion 51, four groove portions 54 are provided. These groove portions 54 are equally spaced apart at 90 degrees in a circumferential direction on an outer surface of the tapered portion 48, which is a tip surface of the ink introducing needle 21, and are also radially arranged around the tip of the needle-like protrusion 23. In other words, the groove portions 54 are arranged in a cross-shaped pattern around the tip of the needle-like protrusion 23 in a state where phases thereof are shifted by 90 degrees, respectively, in the circumferential direction on the outer surface of the tapered portion 48. Moreover, each of the groove portions 54 in this embodiment is formed in a state of linearly extending along the slope of the tapered portion 48 on the outer surface thereof from a start point near the tip of the needle-like protrusion 23 and also penetrating the boundary between the tapered portion 48 and the straight portion 51. Furthermore, inside each of the groove portions 54, each of the ink introducing ports 24 is drilled open across the full width of the groove portion 54.

Figure 8A:
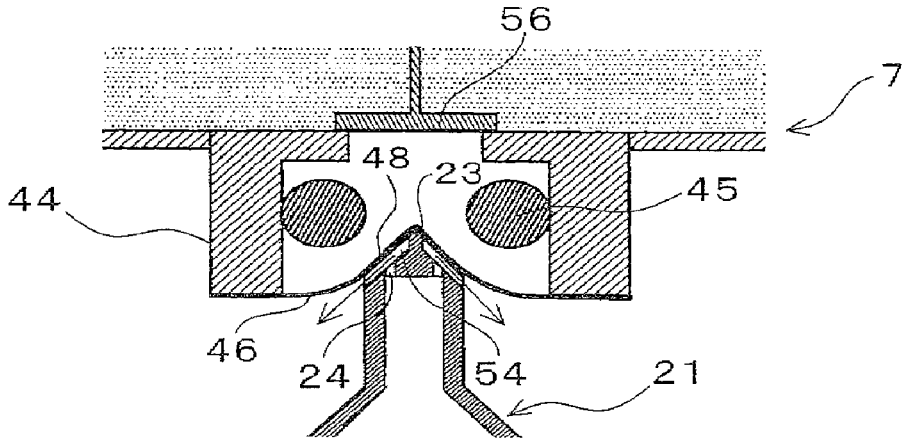
FIGS. 8A to 8C are cross-sectional views when the ink cartridge is mounted on the ink introducing needles.
Figure 8B:
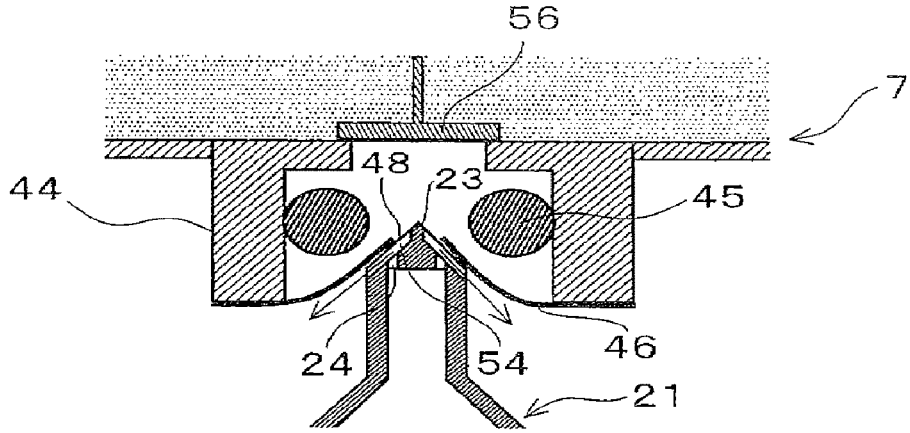
Figure 8C:
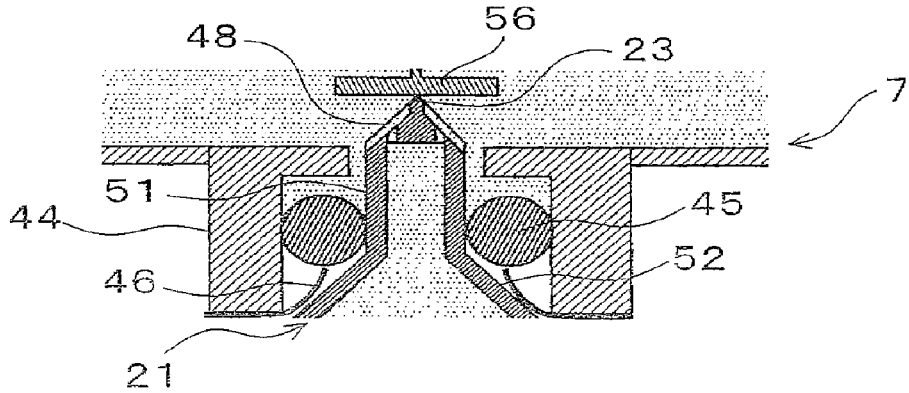

Next, mounting of the ink cartridge 7 on the cartridge mounting part 15' will be described. FIGS. 8A to 8C are cross-sectional views of a main part showing mounting of the ink cartridge on the ink introducing needle (the cartridge mounting part).

As shown in FIGS. 3 and 4, the ink introducing needles 21 are provided upright on the cartridge mounting parts 15' in this embodiment. Therefore, when the ink cartridge 7 is mounted on the cartridge mounting parts 15', as shown in FIG. 8A, the ink cartridge 7 is pushed downward from above the cartridge mounting parts 15' in a state of allowing each of the needle insertion slots 44 to face downward. This pushing bends the sealing film 46 on the needle insertion slot 44 and allows the film to adhere to the outer surface of the tip of the ink introducing needle 21, in other words, the outer surface of the tapered portion 48. When the ink cartridge 7 is pushed down to some extent toward the ink introducing needle 21 from the above state, the needle-like protrusion 23 of the ink introducing needle 21 breaks the sealing film 46, as shown in FIG. 8B.

Here, at the tip of the ink introducing needle 21 in this embodiment, as described above, the groove portions 54 penetrate the boundary between the tapered portion 48 and the straight portion 51 from the positions near the tip of the needle-like protrusion 23. Thus, even if the sealing film 46 on the needle insertion slot 44 is flexed and adheres to the outer surface of the tapered portion 48 of the ink introducing needle 21 when the ink cartridge 7 is mounted, air compressed between the sealing film 46 and the outer surface of the tapered portion 48 is allowed to flow out to the outside from the boundary between the tapered portion 48 and the straight portion 51 through the groove portions 54, as indicated by the arrows in FIGS. 8A and 8B. Moreover, even if a pressure of air inside the needle insertion slot 44 of the ink cartridge 7 is increased by bending the sealing film 46, the air having the increased pressure is also discharged to the outside through the groove portions 54. Therefore, in the mounting of the ink cartridge 7, the air that can turn into bubbles can be prevented from entering the ink introducing needle 21. Thus, compared with the conventional case, a frequency of execution of a cleaning operation for discharging to the outside the bubbles that have entered the ink introducing needle 21 (ink passage) can be reduced. As a result, ink consumption associated with the cleaning operation can be reduced.

Moreover, in the case where the ink cartridge 7 that has been used once is mounted again, it is also conceivable that the broken sealing film 46 on the needle insertion slot 44 comes into contact with or slides on the tapered portion 48 to compress air between the sealing film 46 and the tapered portion 48. Also in this case, as described above, the air compressed between the sealing film 46 and the outer surface of the tapered portion 48 is discharged to the outside through the groove portions 54. Thus, the air can be prevented from entering the ink introducing needle 21 through the ink introducing port 24. As described above, by providing the groove portions 54 in the outer surface of the tapered portion 48, which is the tip surface of the ink introducing needle 21, the bubbles can be prevented from entering the ink introducing needle 21 when the ink cartridge 7 is mounted regardless of whether the ink cartridge 7 has been used or unused.

Furthermore, when the bubbles can be prevented from entering the ink introducing needle 21 in the mounting of the ink cartridge 7 as described above, it is possible to reduce occurrence of problems such as pressure loss in an ejection operation and insufficient supply of ink due to the bubbles flowing into the ink passage. Moreover, an amount of the air that has entered the ink introducing needle 21, if any, is very small. Thus, the air is dissolved in previously deaerated ink. Consequently, the problems can be eliminated even if the cleaning operation only for discharging the bubbles is hardly executed.

Moreover, the ink introducing ports 24 in this embodiment are drilled inside the respective groove portions 54. Thus, the ink introducing ports 24 never directly adhere to the sealing film 46 in the mounting of the ink cartridge 7. Therefore, when the ink cartridge 7 is mounted, the air between the sealing film 46 and the outer surface of the tapered portion 48 is made less likely to be pushed directly into the ink introducing ports 24. Thus, the air is allowed to flow out to the outside through the groove portions 54 having the ink introducing ports 24 provided therein. Consequently, the air can be further prevented from entering the ink introducing needle 21 from the ink introducing ports 24.

Subsequently, as shown in FIG. 8C, when the ink cartridge 7 is pushed down to the base of the ink introducing needle 21, the ink introducing needle 21 is set in a state where the needle-like protrusion 23 and a part of the straight portion 51 are inserted into the ink cartridge 7 (a mounted state of the ink cartridge 7). After the straight portion 51 passes through the O-ring 45, the needle-like protrusion 23 pushes open a valve 56 that prevents leakage of the ink when the ink cartridge 7 is not mounted. Thus, the inside of the ink cartridge 7 and the ink introducing path 38 (the ink passage) are communicated with each other through the ink introducing ports 24. Accordingly, the ink is introduced into the pressure chambers 35 in the recording head 3.

Meanwhile, the invention is not limited to the embodiment described above but various modifications can be made based on the description of claims.

Figure 9A:
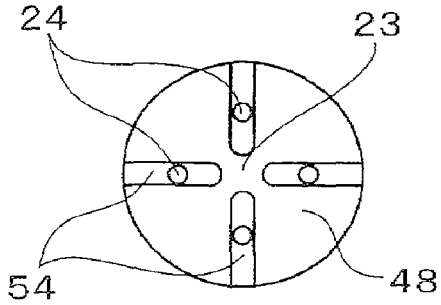
FIG. 9A is a plan view.
Figure 9B:
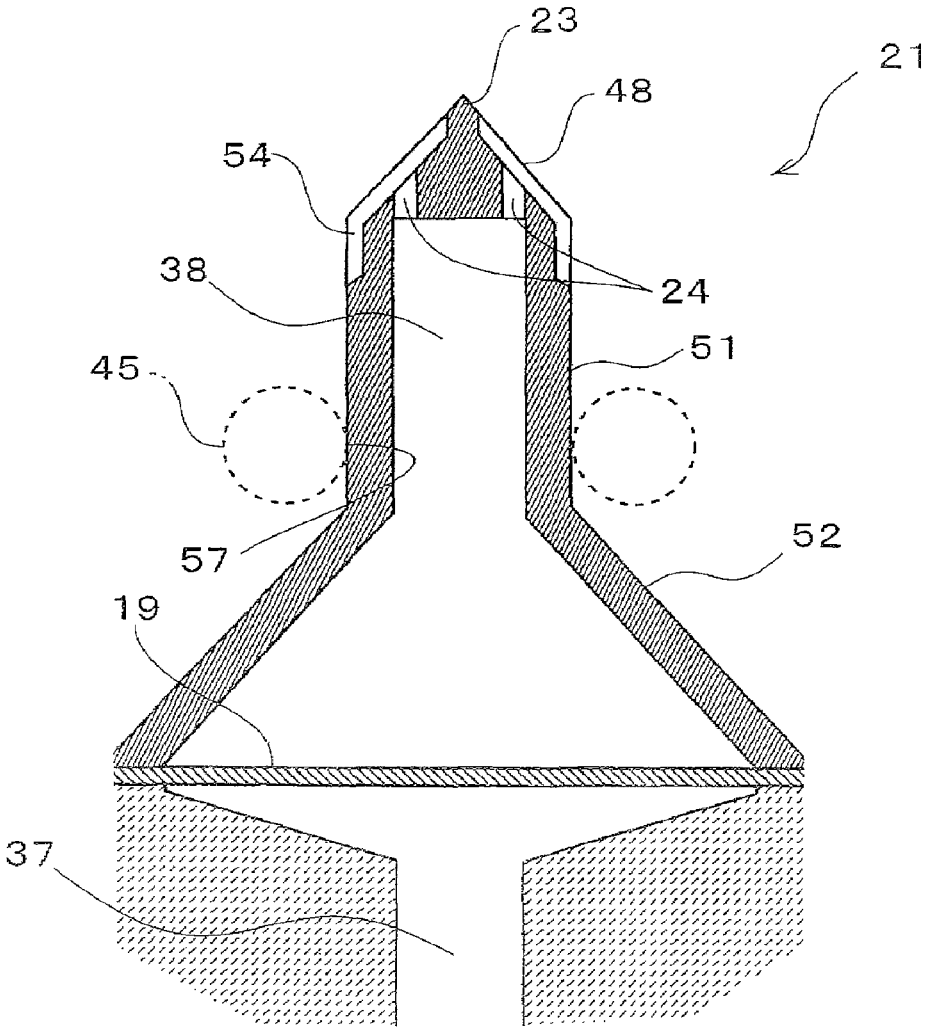
FIG. 9B is a cross-sectional view showing one of ink introducing needles.

In the above embodiment, the description was given by taking, as an example, the configuration in which the groove portions 54 of the ink introducing needle 21 penetrate the boundary between the tapered portion 48 and the straight portion 51 from the positions near the tip of the needle-like protrusion 23. However, the invention is not limited thereto but may adopt a configuration in which the groove portions 54 are continuously formed up to the middle of the outer peripheral surface of the straight portion 51 from the tapered portion 48, as shown in FIG. 9B.

Such a configuration enables the air between the sealing film 46 on the needle insertion slot 44 and the outer surface of the tapered portion 48 of the ink introducing needle 21 to surely flow out to the outside through the groove portions 54 extending to the outer peripheral surface of the straight portion 51 even if the sealing film 46 adheres from the outer surface of the tapered portion 48 to the outer peripheral surface of the straight portion 51. Therefore, the air between the sealing film 46 and the outer surface of the tapered portion 48 can be more surely prevented from entering the ink introducing needle 21 from the ink introducing ports 24 when the ink cartridge 7 is mounted. Note that the groove portions 54 in the outer peripheral surface of the straight portion 51 in this embodiment are formed in the positions closer to the tip (the tapered portion 48) than an O-ring contact region 57 with which the O-ring 45 comes into contact when the ink cartridge 7 is mounted from the tapered portion 48 side. This is because, when the groove portions 54 extend to the O-ring contact region 57, the inside of the needle insertion slot 44 cannot be set in a liquid-tight state and thus ink leakage occurs when the ink cartridge 7 is mounted (see FIG. 9B).

Figure 10A:
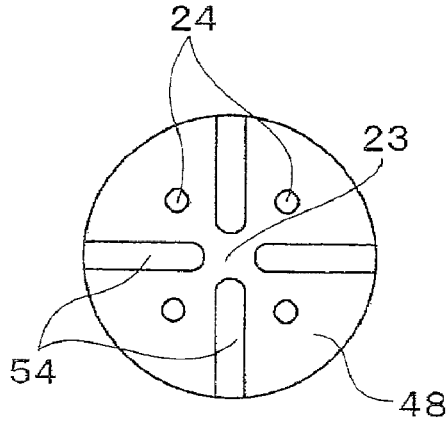
FIGS. 10A to 10C are plan views of ink introducing needles.
Figure 10B:
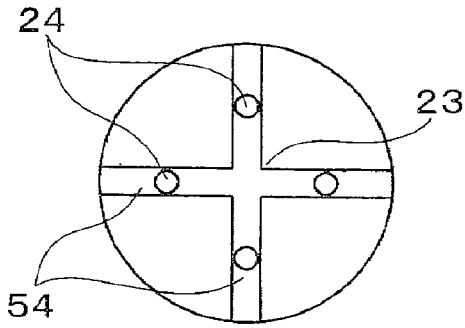
Figure 10C:
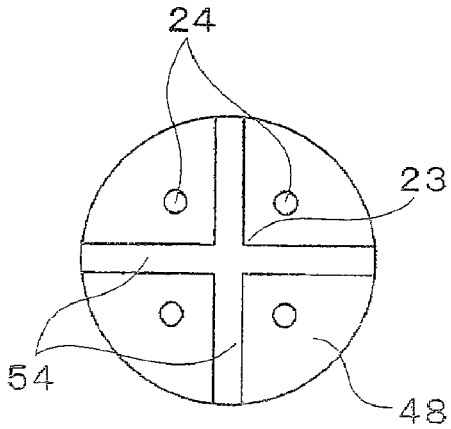

Moreover, in the above embodiment, the description was given by taking, as an example, the configuration in which the ink introducing ports 24 are provided inside the groove portions 54. However, the invention is not limited thereto but may adopt a configuration in which the ink introducing ports 24 are provided in the outer surface of the tapered portion 48 outside the groove portions 54. For example, as shown in FIG. 10A, the ink introducing ports 24 may be provided between the groove portions 54. Moreover, the needle-like protrusion 23 and the groove portions 54 are also not limited to the configurations described in the above embodiment. As shown in FIG. 10B, the groove portions 54 may be communicated with each other at the tip of the ink introducing needle 21. Furthermore, the configurations described above may be combined to form the groove portions 54 to be communicated with each other at the tip of the ink introducing needle 21 and also provide the ink introducing ports 24 between the groove portions 54, as shown in FIG. 10C. Moreover, the groove portions 54 penetrate the boundary between the tapered portion 48 and the straight portion 51 from the vicinity of the tip of the needle-like protrusion 23 but do not always have to penetrate the boundary therebetween. Even if the groove portions 54 do not penetrate the boundary, the compressed air between the sealing film 46 and the tapered portion 48 is allowed to flow out to the outside. In other words, any arrangement of the groove portions 54 or the ink introducing ports 24 can be set in the invention as long as the compressed air between the sealing film 46 and the tapered portion 48 is allowed to flow out to the outside of the ink introducing needle 21 through the groove portions 54 without allowing the air to enter the ink introducing ports 24 when the ink cartridge 7 is mounted. Moreover, the number of the groove portions 54 or the ink introducing ports 24 can also be arbitrarily set.

Embodiment 2

Although the groove portions 54 are provided in the ink introducing needle 21 to discharge the air inside the needle insertion slot 44 to the outside in Embodiment 1, the air inside the needle insertion slot 44 can be more surely discharged to the outside by providing the groove portions in accordance with the sealing film 46 that seals the needle insertion slot 44. An ink introducing needle according to this embodiment will be described below. Note that the same parts as those in Embodiment 1 will be denoted by the same reference numerals and repetitive description will be omitted.

Figure 11:
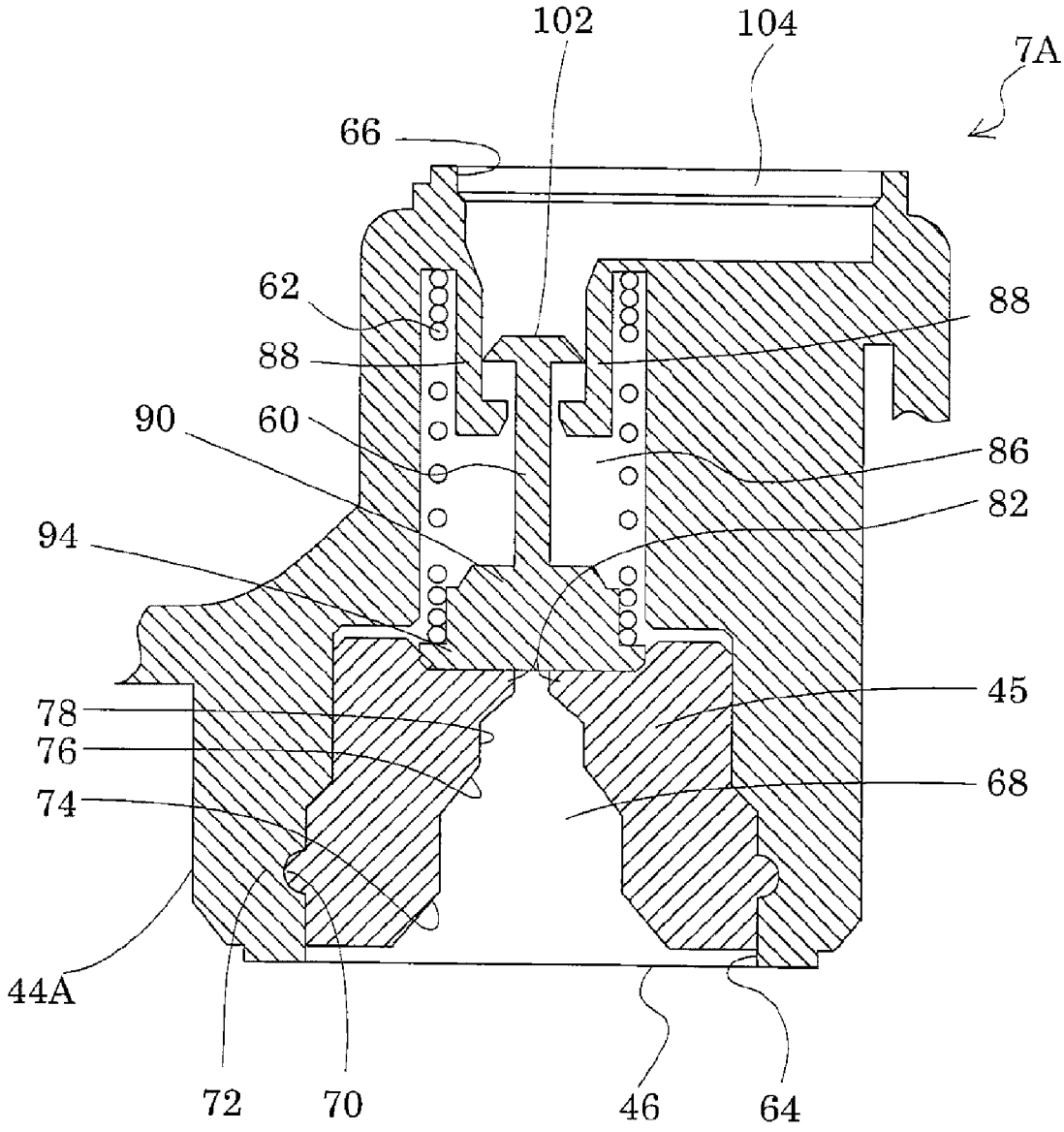
FIG. 11 is a cross-sectional view of a needle insertion slot section in an ink cartridge.
Figure 12:
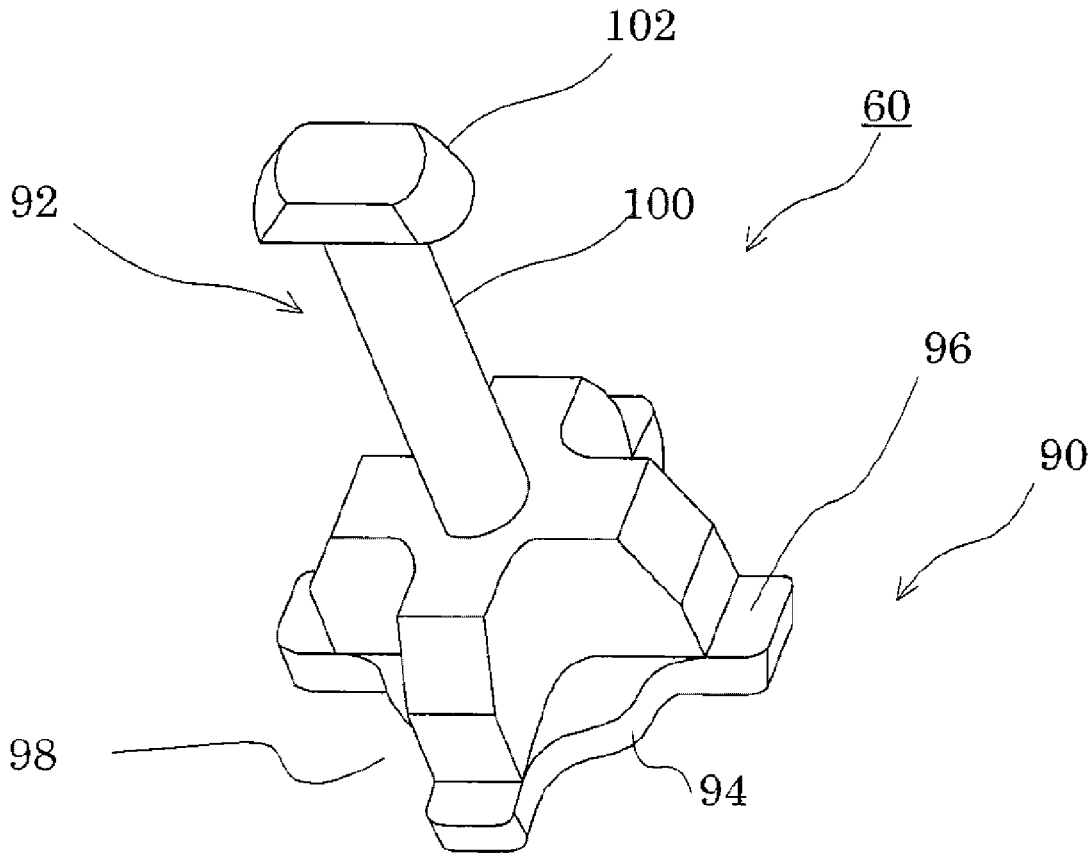
FIG. 12 is a perspective view of a valve body in the ink cartridge.

First, an ink cartridge 7A will be described. FIG. 11 is a cross-sectional view of a needle insertion slot section in the ink cartridge. FIG. 12 is a perspective view of a valve body in the ink cartridge.

The ink cartridge 7A is a member that functions as a kind of the liquid storage member of the invention, and in which ink to be supplied to a recording head 3 is stored. A printer 1 of this embodiment is configured to be able to eject eight kinds of ink, to be more specific, eight colors of ink, including yellow, magenta, cyan, matte black, photo black, red, blue and gloss optimizer (clear). On the recording head 3, eight ink cartridges 7A in total, in which the respective colors of ink are individually stored, are loaded.

As shown in FIG. 11, in a bottom surface of each of the ink cartridges 7, a needle insertion slot 44A (an ink outlet) is provided, into which an ink introducing needle 21A is to be inserted. On a side of the needle insertion slot 44A, which is opposite to the ink introducing needle 21A, an external opening 64 is formed. Moreover, on a side opposite to the external opening, an internal opening 66 is formed. The needle insertion slot 44A is communicated with an ink storage chamber (not shown) in the ink cartridge 7A, in which ink is stored, through the internal opening 66.

A sealing member 45 is press-fitted into the needle insertion slot 44A and has a through-hole 68 formed in its center portion, in which the ink introducing needle 21A can be received. Moreover, a convex portion 70 is formed in a peripheral portion of the sealing member 45. This convex portion 70 is engaged with a concave portion 72 formed in a side wall of the needle insertion slot 44A. Thus, the sealing member 45 is fixed inside the needle insertion slot 44A. The sealing member 45 and the needle insertion slot 44A are connected to each other in a liquid-tight state by the convex portion 70 of the sealing member 45 and the concave portion 72 formed in the needle insertion slot 44A. Thus, the ink is prevented from leaking out from between the peripheral portion of the sealing member 45 and the side wall of the needle insertion slot 44A.

The sealing member 45 is made of a rubber material such as silicon rubber, chloroprene rubber, butyl rubber, ethylene-propylene rubber and nitrile rubber or an elastic material such as an elastomeric material. Moreover, in a region of an inner peripheral surface of the sealing member 45, with which the ink introducing needle 21A comes into contact, a smooth-surfaced layer coated with silicon resin, fluororesin or the like is formed as needed to facilitate insertion of the ink introducing needle 21A.

In an inner peripheral portion of the sealing member 45, first and second tapered portions 74 and 76 which guide the ink introducing needle 21A and a cylindrical fitting portion 78 in which the ink introducing needle 21A is fitted are formed. Specifically, the first and second tapered portions 74 and 76 extend in a tapered manner toward the internal opening 66 from the external opening 64. Moreover, on the internal opening 66 side of the sealing member 45, a pleat portion 82 having a diameter smaller than an outside diameter of the ink introducing needle is formed to provide an ink passage. This pleat portion 82 extends by insertion of the ink introducing needle 21A and is fitted to the periphery of the ink introducing needle 21A in a liquid-tight state.

An ink guide chamber 86 is formed between the sealing member 45 fixed to the needle insertion slot 44A and the internal opening 66. In this ink guide chamber 86, a valve body 60 is housed. The ink guide chamber 86 has a cylindrical guide portion 88 which is engaged with a part of the valve body 60 to guide the valve body 60 to be movable approximately perpendicularly to the sealing member 45. The guide portion 88 has a through-hole provided therein. The valve body 60 is constantly energized toward the sealing member 45 by a compression spring 62 and selectively seals the ink passage in the sealing member 45.

FIG. 12 shows an example of the valve body 60. The valve body 60 has: a valve body portion 90 which elastically comes into contact with a surface of an ink storage chamber in the sealing member 45; and a guide member 92 which guides the valve body portion 90 to be movable approximately perpendicularly to the sealing member 45 in the needle insertion slot 44A when the valve body is housed in the ink guide chamber 86. The valve body portion 90 has: a flat plate-like sealing portion 94 which seals the ink from the ink storage chamber when the valve body portion 90 elastically comes into contact with the sealing member 45; a spring holding portion 96 which holds the spring that energizes the valve body 60 to elastically come into contact with the sealing member 45; and an ink passage 98 which allows the ink from the ink storage chamber to pass when the valve body portion 90 is pushed by the ink introducing needle 21A in the recording apparatus and separated from the sealing member 45. Here, the ink passage 98 is formed by cutting the sealing portion 94. The guide member 92 has a shaft 100 connected to the valve body portion 90 and a retaining portion 102 formed on a free end of the shaft 100. The retaining portion 102 has a diameter larger than that of the through-hole, which enables its movement inside the guide portion 88 in the ink guide chamber 86.

Referring back to FIG. 11, the retaining portion 102 of the valve body 60 is engaged with the guide portion 88 provided inside the ink guide chamber 86 and guides the valve body portion 90 to be movable approximately perpendicularly to the sealing member 45.

Meanwhile, the recording head 3 of a so-called piezoelectric type mechanically enlarges a pressure generating chamber by use of a piezoelectric vibrator or the like, supplies ink into the chamber and ejects ink droplets by compression. Regarding an ink cartridge used in the recording head 3 as described above, the ink cannot be sufficiently pressurized when bubbles are generated in the pressure generating chamber in the recording head 3. Thus, it is necessary to eliminate the bubbles by dissolving the bubbles in the ink at the time of ink production.

Thus, in this case, the ink is injected into the ink cartridge in a manufacturing process thereof in a state where a pressure in the ink storage chamber is reduced up to about minus one atmosphere (6033 kg/square meter) relative to the atmospheric pressure. Therefore, an elastic pressure of the spring 62 is set to make it possible to maintain the state where the valve body 60 is in elastic contact with the sealing member 45 even if the pressure in the ink storage chamber is reduced.

The internal opening 66 formed on the ink storage chamber side of the needle insertion slot 44A has an area larger than that of the ink guide chamber 86 having the valve body 60 housed therein. Thus, passage resistance is reduced and a sufficient amount of liquid ink can be supplied to the ink introducing needle 21A. Moreover, between the internal opening 66 and the ink storage chamber, a filter 104 is provided. Thus, dust or the like mixed in the ink inside the ink storage chamber, if any, is removed by the filter 104 and not supplied to the recording head 3. Furthermore, the filter 104 has substantially the same size as that of the internal opening 66, thereby leading to an advantage of reducing the passage resistance and suppressing clogging.

The external opening 64 is sealed by attaching thereto a sealing film 46 that is a kind of sealing member. This sealing film 46 is a seal for preventing leakage and evaporation of the ink stored in the ink cartridge 7A that is unused. Moreover, as the sealing film, for example, a thin (a thickness of, for example, about 39 μm) breakable resin film such as PP (polypropylene) is preferably used. As described later, the sealing film is broken by the ink introducing needle 21A in loading of the ink cartridge 7A. The sealing film 46 is formed by rolling in a rolling direction Y (see FIG. 13A) and thus is easily broken along a direction (hereinafter referred to as a "breaking direction X" (see FIG. 13A)) perpendicular to the rolling direction Y in loading of the ink cartridge. Specifically, a shape of a broken portion when the sealing film 46 is broken is not circular but longer in the breaking direction X than in the rolling direction Y. Note that the sealing film 46 is not limited to that formed by rolling but any film may be used as long as a breakable direction is set therein. For example, a sealing film that is half cut in one direction may be used.

Figure 13A:
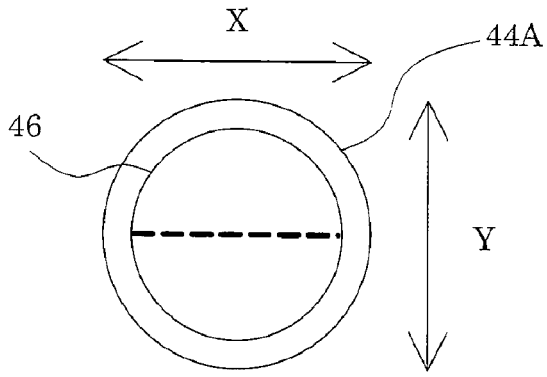
FIG. 13A is a plan view of a needle insertion slot.
Figure 13B:
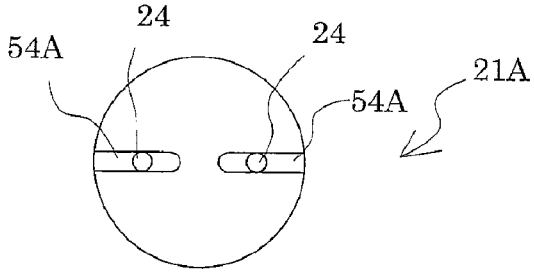
FIG. 13B is a plan view of an ink introducing needle.
Figure 13C:
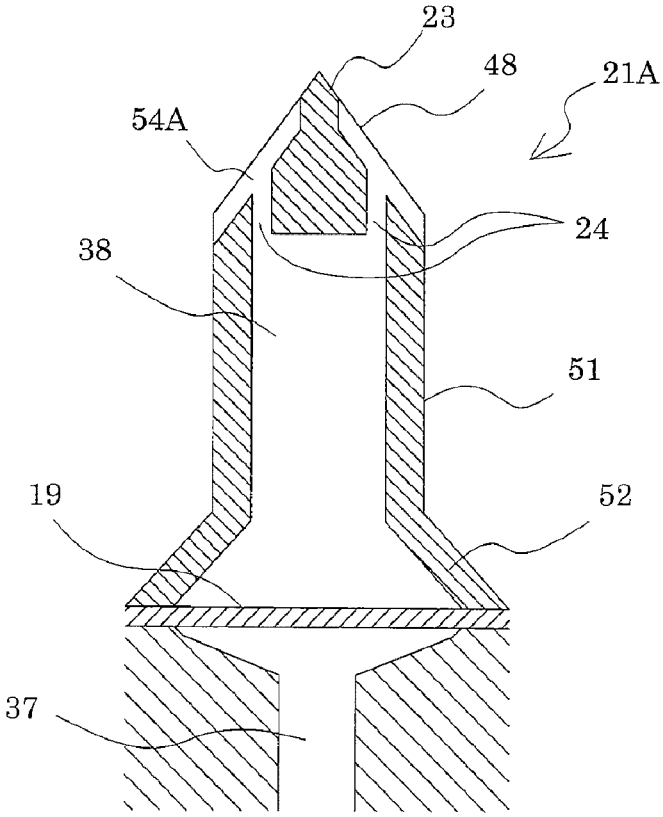
FIG. 13C is a cross-sectional view of the ink introducing needle.

Next, the ink introducing needle 21A will be described. FIGS. 13A to 13C are views showing a configuration of the ink introducing needle 21A. FIG. 13A is a plan view of the needle insertion slot in the ink cartridge. FIG. 13B is a plan view of the ink introducing needle 21A. FIG. 13C is a cross-sectional view of the ink introducing needle 21A, taken along the longitudinal direction. The ink introducing needle 21A that is an example of the liquid introducing columnar body to be inserted into the ink cartridge 7A is, as shown in FIGS. 13B and 13C, a hollow needle having an ink introducing path 38 (a kind of liquid passage) formed therein. Moreover, the ink introducing needle 21A consists of: a needle-like protrusion 23 having a tapered portion 48 whose diameter is gradually increased toward its base from its tip; a cylindrical straight portion 51 formed linearly continuously with the needle-like protrusion 23; and a skirt-shaped increased diameter portion 52 having a diameter being gradually increased toward a downstream side of the straight portion 51 from a lower end thereof. At the tip of the tapered portion 48, ink introducing ports 24 (a kind of liquid introducing port in the invention) are drilled, which communicate an external space with the ink introducing path 38. Moreover, the ink introducing needle 21A is mounted on the introducing needle unit 15 by ultrasonic welding, for example, in a state where an opening at a lower end of the increased diameter portion 52 faces the filter 19 (see FIGS. 3 and 4). Thus, the ink introducing path 38 in the ink introducing needle 21A and the head passage 37 in the head case 16 are communicated with each other in a liquid-tight state. Accordingly, the area of the opening at the lower end of the increased diameter portion 52 becomes an effective filtration area of the filter 19 disposed immediately therebelow. Note that the ink introducing path 38 and the head passage 37 function as the liquid passages in the invention.

The straight portion 51 is a hollow cylindrical member to be inserted into the ink cartridge 7A. Moreover, the straight portion 51 is configured to make it easy for the conical needle-like protrusion 23 formed at its tip to break the sealing film 46 and to thus be inserted into the needle insertion slot 44 when the ink cartridge 7A is loaded. In an outer surface of the tapered portion 48 of the needle-like protrusion 23 (a tip surface of the ink introducing needle 21A), two groove portions 54A extend from positions slightly lower along the slope than the tip of the needle-like protrusion 23 to edge portions of the tapered portion 48. As shown in FIG. 13B, a longitudinal direction of each of the groove portions 54A coincides with the breaking direction X of the sealing film 46 in the ink cartridge 7A. Furthermore, inside each of the groove portions 54, a corresponding one of the ink introducing ports 24 is drilled open across the full width of the groove portion 54A.

Next, description will be given of the mounting of the ink cartridge 7A on cartridge mounting parts 15'. FIGS. 14 and 15 are cross-sectional views showing how the ink cartridge is mounted on the ink introducing needles (the cartridge mounting parts) and plan views of the ink introducing needle when viewed from the arrow A-A direction.

Figure 14A:
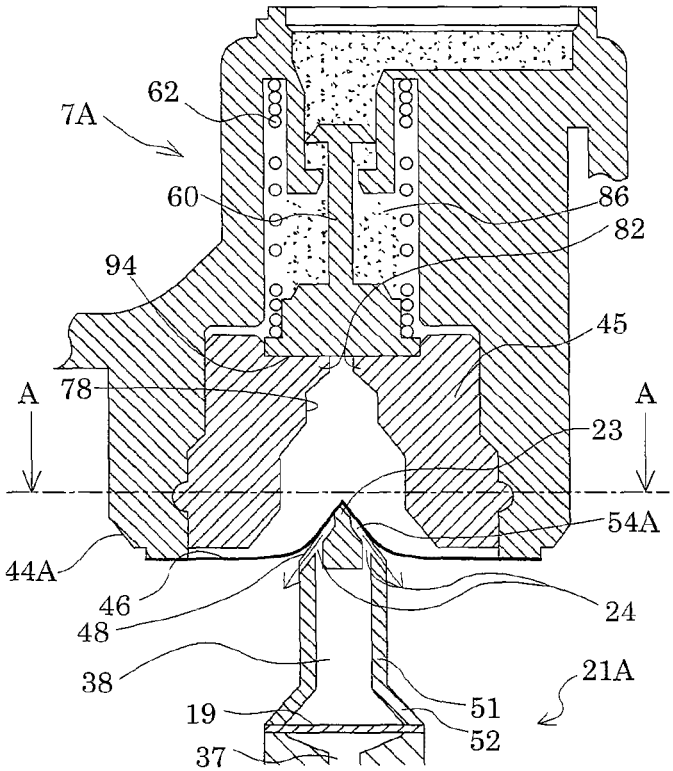
FIGS. 14A and 14C are cross-sectional views showing how the ink cartridge is mounted on the ink introducing needles and FIGS. 14B and 14D are plan views of the ink introducing needle when viewed from the arrow A-A direction in FIGS. 14A and 14C.
Figure 14B:
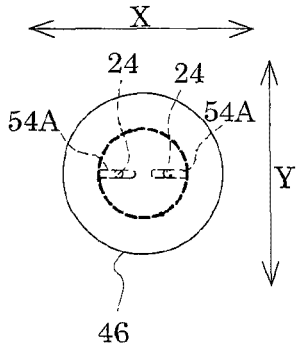
Figure 14C:
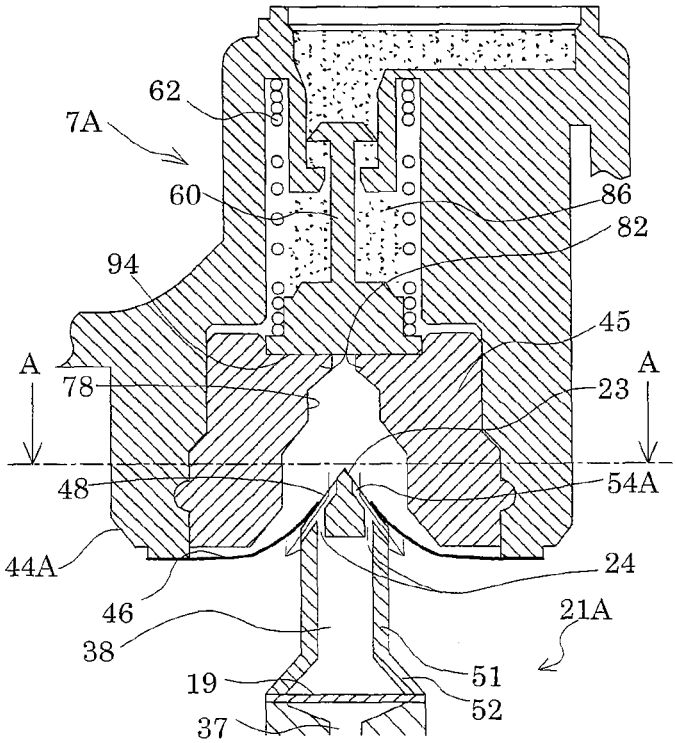
Figure 14D:
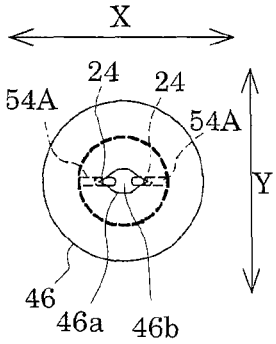
Figure 15A:
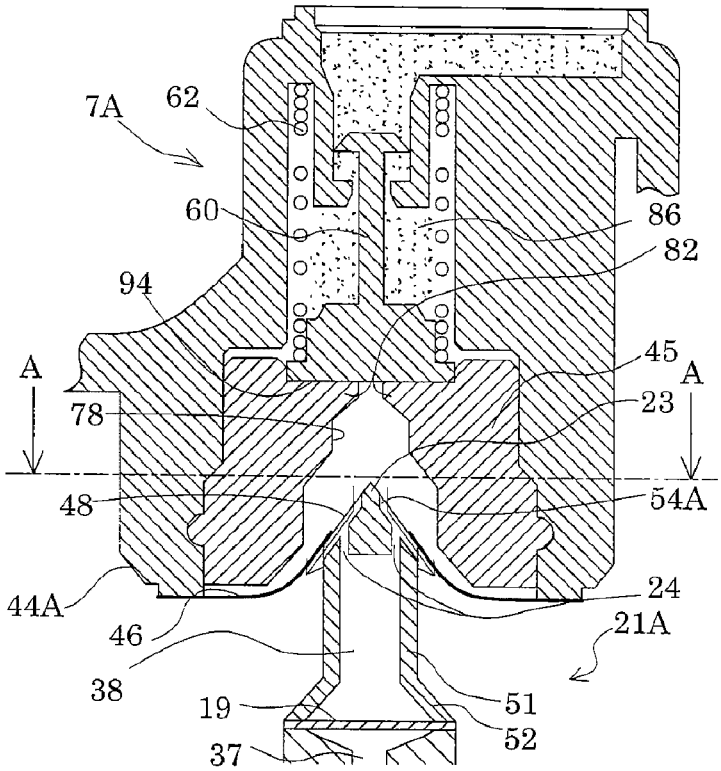
FIGS. 15A and 15C are cross-sectional views showing how the ink cartridge is mounted on the ink introducing needles and FIGS. 15B and 15D are plan views of the ink introducing needle when viewed from the arrow A-A direction in FIGS. 15A and 15C.
Figure 15B:
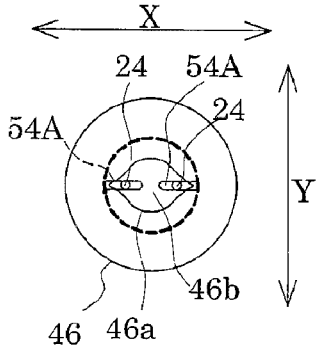

As shown in FIGS. 3 and 4, the ink introducing needles 21A are provided upright on the cartridge mounting parts 15' in this embodiment. Therefore, when the ink cartridge 7A is mounted on the cartridge mounting parts 15', as shown in FIG. 14A, the ink cartridge 7A is pushed downward from above the cartridge mounting parts 15' in a state where each of the needle insertion slots 44A faces downward. This pushing bends the sealing film 46 on the needle insertion slot 44 and allows the film to adhere to the outer surface of the tip of the ink introducing needle 21A, that is, the outer surface of the tapered portion 48 of the needle-like protrusion 23. FIG. 14B is a plan view of the ink introducing needle when viewed from the arrow A-A direction in FIG. 14A. As shown in FIG. 14B, the longitudinal direction of each of the groove portions 54A in the ink introducing needle 21A coincides with the breaking direction X of the sealing film 46. When the ink cartridge 7A is pushed down to some extent toward the ink introducing needle 21A in the above state, the needle-like protrusion 23 of the ink introducing needle 21A breaks the sealing film 46, as shown in FIG. 14C. In this event, as shown in FIG. 14D, the sealing film 46 is broken along the breaking direction X by the needle-like protrusion 23. Moreover, a part of each of the groove portions 54A faces an opening (hereinafter referred to as an "opening portion 46*b*") of a broken portion of the sealing film 46 (hereinafter referred to as a "broken portion 46*a*"). Thereafter, as shown in FIGS. 15A and 15B, the ink cartridge 7A is further pushed into the cartridge mounting part 15' and the broken portion 46*a* is opened more widely in the breaking direction X than in the rolling direction Y. Accordingly, more portions of the groove portions 54A face the opening portion 46*b*.

Here, at the tip of the ink introducing needle 21A in this embodiment, as described above, the groove portions 54A extend from the vicinity of the tip of the needle-like protrusion 23 to the edge portion of the tapered portion 48. Thus, even if the sealing film 46 on the needle insertion slot 44A is flexed and adheres to the outer surface of the tapered portion 48 of the needle-like protrusion 23 in the ink introducing needle 21 when the ink cartridge 7A is mounted, air compressed between the sealing film 46 and the outer surface of the tapered portion 48 is allowed to flow out to the outside from a boundary between the tapered portion 48 and the straight portion 51, as indicated by the arrows in FIG. 14A. Moreover, even if a pressure of air inside the needle insertion slot 44A of the ink cartridge 7A is increased by flexing the sealing film 46, the air having the increased pressure is also discharged to the outside through the groove portions 54A, as indicated by the arrows in FIGS. 14C and 15A. To be more specific, as shown in FIGS. 14D and 15B, when the sealing film 46 is broken by the needle-like protrusion 23, the broken portion 46*a* of the sealing film 46 is wider in the breaking direction X than in the rolling direction Y. Meanwhile, since the longitudinal direction of each of the groove portions 54A coincides with the breaking direction X, a large area can be secured for communicating the groove portions 54A with the inside of the needle insertion slot 44A through the opening portion 46*b* of the broken portion 46*a*. Thus, it becomes easy for the air inside the needle insertion slot 44A in the ink cartridge 7A to flow into each groove portion 54A. Consequently, the air can be more surely prevented from entering the ink introducing needle 21A.

As described above, the air is prevented from entering the ink introducing needle 21A. Thus, compared with the conventional case, a frequency of execution of a cleaning operation for discharging bubbles flowing into the ink introducing needle 21A (ink passage) to the outside can be reduced. As a result, ink consumption associated with the cleaning operation can be reduced.

Moreover, in the case where the ink cartridge 7A that has been used once is mounted again, it is also conceivable that the broken sealing film 46 on the needle insertion slot 44A comes into contact with or slides on the tapered portion 48 to compress air between the sealing film 46 and the tapered portion 48. Also in this case, as described above, the air compressed between the sealing film 46 and the outer surface of the tapered portion 48 can be discharged to the outside through each groove portion 54A. Thus, the air can be prevented from entering the ink introducing needle 21A through the ink introducing ports 24. As described above, by providing the groove portions 54A in the outer surface of the tapered portion 48 of the needle-like protrusion 23 in the ink introducing needle 21A, the bubbles can be prevented from entering the ink introducing needle 21A when the ink cartridge 7A is mounted regardless of whether the ink cartridge 7A has been used or unused.

Furthermore, when the bubbles can be prevented from entering the ink introducing needle 21A in the mounting of the ink cartridge 7A as described above, it is possible to reduce occurrence of problems such as pressure loss in an ejection operation and insufficient supply of ink due to the bubbles flowing into the ink passage. Moreover, an amount of the air that has entered the ink introducing needle 21A, if any, is very small. Thus, the air is dissolved in previously deaerated ink. Consequently, the problems can be eliminated even if the cleaning operation only for discharging the bubbles is hardly executed.

Moreover, the ink introducing ports 24 in this embodiment are drilled inside the respective groove portions 54A. Thus, the ink introducing ports 24 never directly adhere to the sealing film 46 in the mounting of the ink cartridge 7A. Therefore, when the ink cartridge 7A is mounted, the air between the sealing film 46 and the outer surface of the tapered portion 48 can be made less likely to be pushed directly into the ink introducing ports 24. Thus, the air is allowed to flow out to the outside through the groove portions 54A having the ink introducing ports 24 provided therein. Consequently, the air can be further prevented from entering the ink introducing needle 21A from the ink introducing ports 24.

Figure 15C:
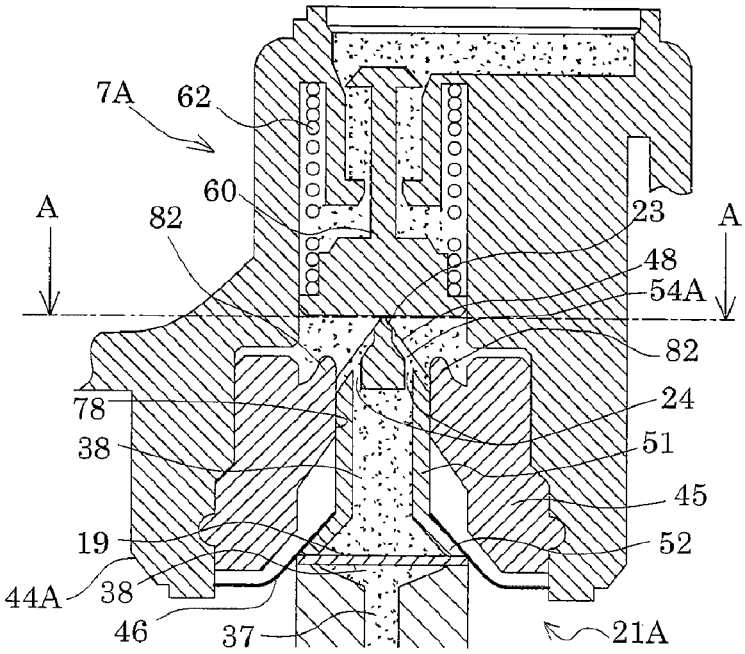
Figure 15D:
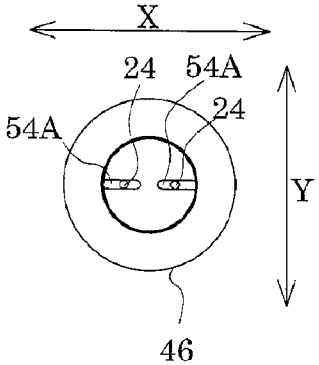

Subsequently, as shown in FIGS. 15C and 15D, when the ink cartridge 7A is pushed down to the base of the ink introducing needle 21A, the ink introducing needle 21A breaks the sealing film 46 and is also set in a state where the needle-like protrusion 23 and a part of the straight portion 51 are inserted into the ink cartridge 7A (a mounted state of the ink cartridge 7A). After the straight portion 51 is fitted into the fitting portion 78 in the sealing member 45 and the needle-like protrusion 23 penetrates the pleat portion 82 in the sealing member 45, the needle-like protrusion 23 pushes open the valve body 60. Thus, the ink storage chamber in the ink cartridge 7A and the ink introducing path 38 (the ink passage) are communicated with each other through the ink introducing ports 24. Accordingly, the ink is introduced into the pressure chambers 35 in the recording head 3.

Figure 16A:
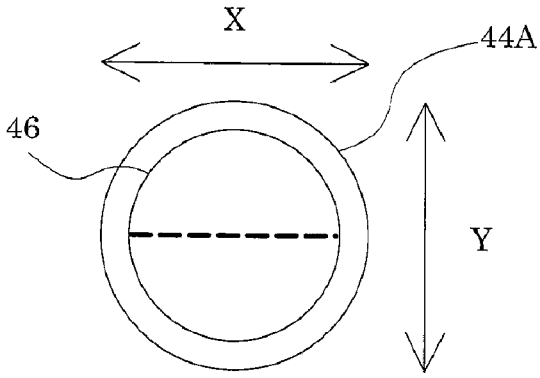
FIG. 16A is a plan view of the needle insertion slot.
Figure 16B:
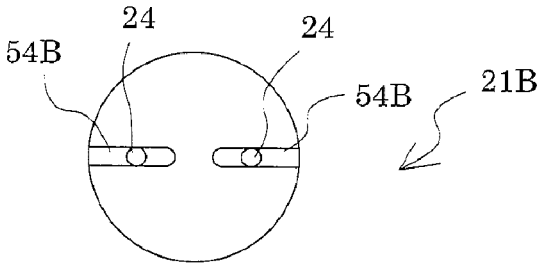
FIG. 16B is a plan view of an ink introducing needle.
Figure 16C:
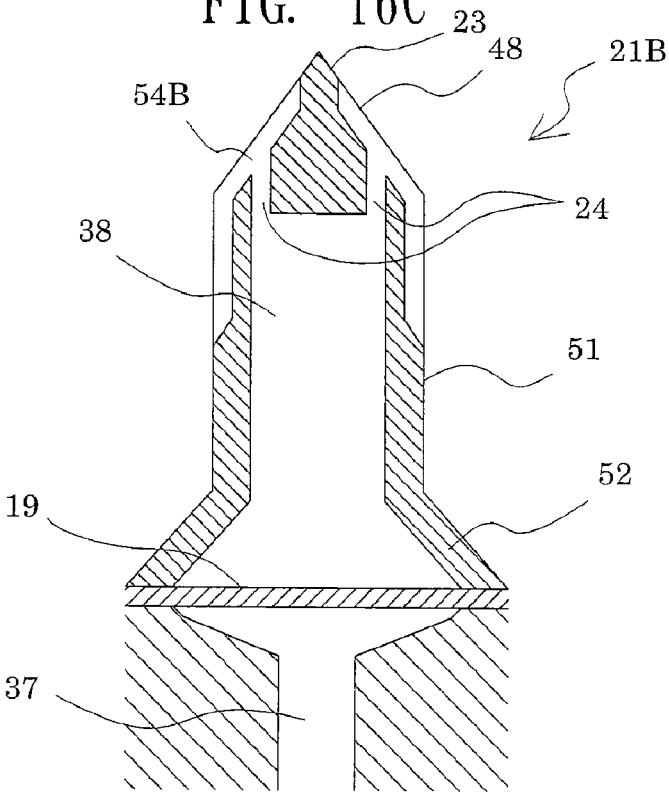
FIG. 16C is a cross-sectional view of the ink introducing needle.

In the ink introducing needle 21A, the groove portions 54A extend from the vicinity of the needle-like protrusion 23 to the edge portion of the tapered portion 48. However, the invention is not limited thereto but may adopt a configuration in which the groove portions 54A continuously extend up to the middle of the outer peripheral surface of the straight portion 51, as shown in FIGS. 16A to 16C.

Figure 17:
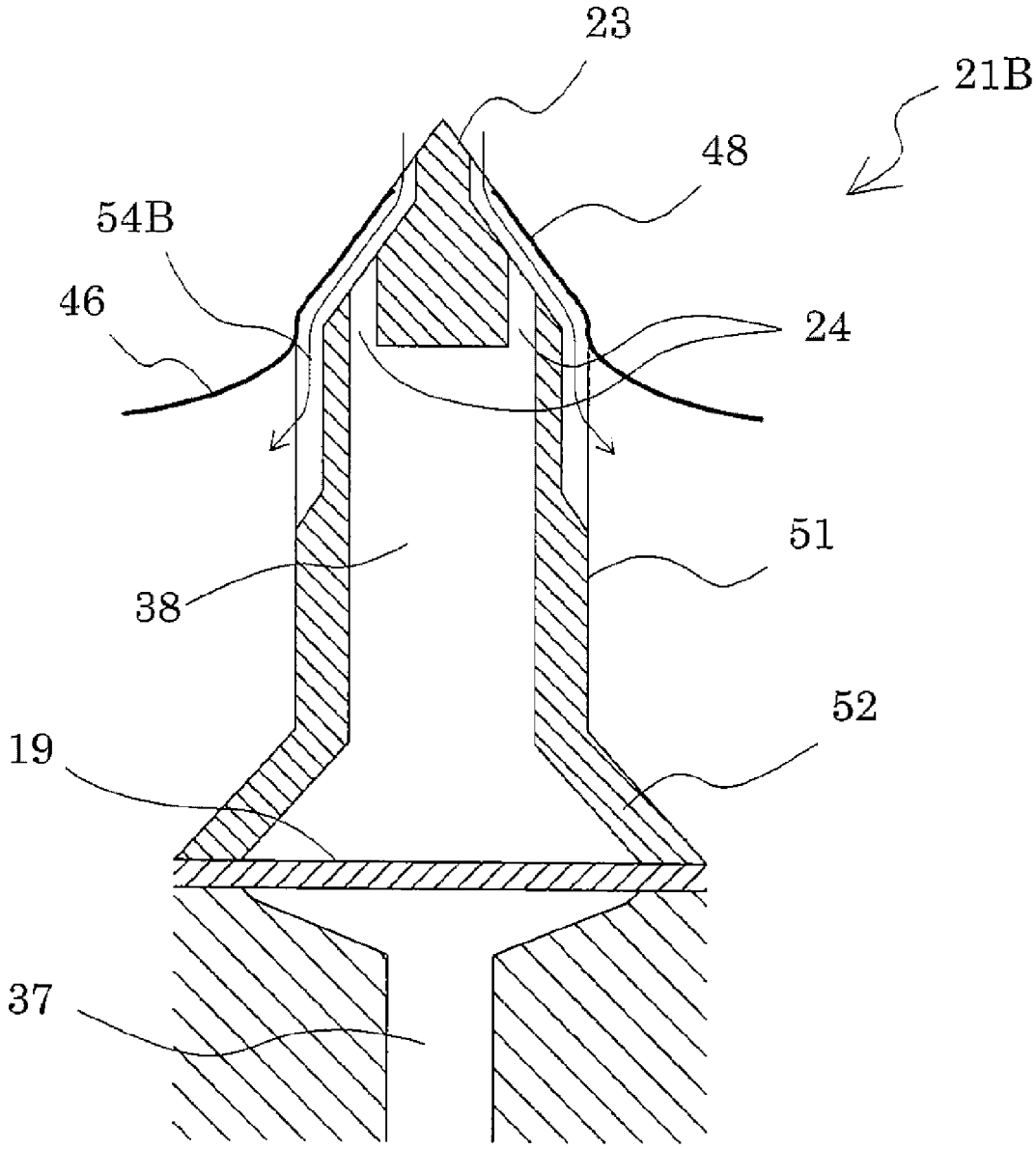
FIG. 17 is a cross-sectional view of the ink introducing needle.

Such a configuration enables air between the sealing film 46 on the needle insertion slot 44A and an outer surface of a tapered portion 48 in an ink introducing needle 21B to surely flow out to the outside through groove portions 54B extending to the outer peripheral surface of the straight portion 51 even if the sealing film 46 adheres from the entire outer surface of the tapered portion 48 to an upper part of the outer peripheral surface of the straight portion 51 when the ink cartridge 7A is mounted, as shown in FIG. 17. Therefore, the air between the sealing film 46 and the outer surface of the tapered portion 48 can be more surely prevented from entering the ink introducing needle 21B from the ink introducing ports 24 when the ink cartridge 7A is mounted.

Note that the groove portions 54B in the outer peripheral surface of the straight portion 51 in the ink introducing needle 21B are formed in the positions closer to the tip (the tapered portion 48) than a region in which the sealing member 45 comes into contact with the straight portion 51 when the ink cartridge 7A is mounted. This is because, since the groove portions 54B extend to the region, the inside of the needle insertion slot 44A cannot be set in a liquid-tight state and thus ink leakage occurs when the ink cartridge 7A is mounted.

Figure 18A:
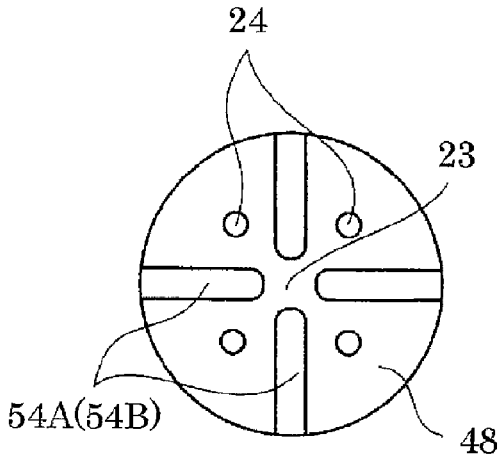
FIGS. 18A to 18C are plan views of ink introducing needles.
Figure 18B:
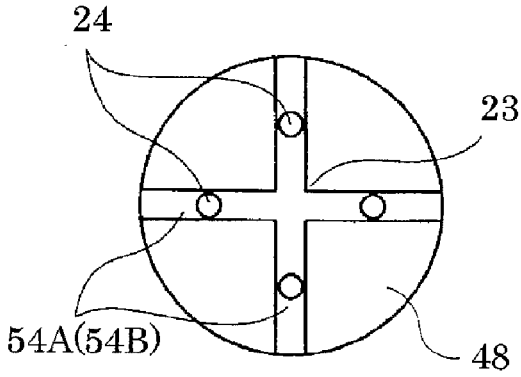
Figure 18C:
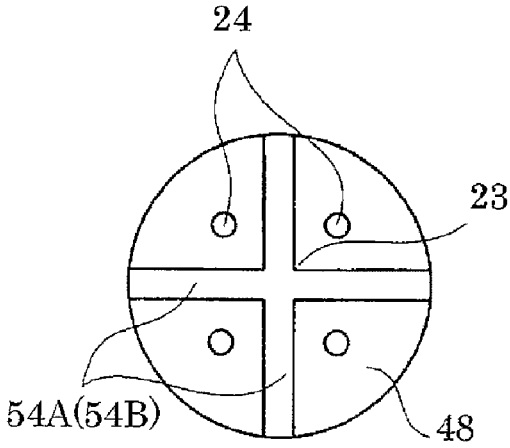

Moreover, in this embodiment, the two groove portions 54A in total are provided along the breaking direction X of the sealing film 46 in the ink introducing needle 21A, and the two groove portions 54B in total are also provided along the breaking direction X of the sealing film 46 in the ink introducing needle 21B. However, the invention is not limited thereto. For example, as shown in FIGS. 18A to 18C, four groove portions 54A in total may be provided to be equally spaced apart at 90 degrees in a circumferential direction of the outer surface of the tapered portion 48 in the ink introducing needle 21A and also radially arranged around the tip of the needle-like protrusion 23. As to the ink introducing needle 21B, four groove portions 54B in total may be similarly provided. This is because, as to the groove portions 54A and 54B, at least one groove portion may be provided in the tip surface of the ink introducing needle 21A to allow the longitudinal direction thereof to coincide with the breaking direction X. By providing the groove portions 54A or 54B as described above, the air between the sealing film 46 and the outer surface of the tapered portion 48 can be more surely prevented from entering the ink introducing needle 21A or 21B from the ink introducing ports 24.

Moreover, the description was given by taking, as an example, the configuration in which the ink introducing ports 24 are provided inside the groove portions 54A or 54B. However, the invention is not limited thereto but may adopt a configuration in which the ink introducing ports 24 are provided in the outer surface of the tapered portion 48 outside the groove portions 54A and 54B. For example, as shown in FIG. 18A, the ink introducing ports 24 may be provided between the groove portions 54A or between the groove portions 54B. Moreover, the needle-like protrusion 23 and the groove portions 54A and 54B are also not limited to the configurations described in the above embodiment. As shown in FIG. 18B, the groove portions 54A may be communicated with each other at the tip of the ink introducing needle 21A. Similarly, the groove portions 54B may be communicated with each other at the tip of the ink introducing needle 21B. Furthermore, the configurations described above may be combined to form the groove portions 54A to be communicated with each other at the tip of the ink introducing needle 21A and also provide the ink introducing ports 24 between the groove portions 54A, as shown in FIG. 18C. Similarly, the groove portions 54B may be communicated with each other at the tip of the ink introducing needle 21B and the ink introducing ports 24 may be provided between the groove portions 54B. Moreover, the groove portions 54A and 54B penetrate the boundary between the tapered portion 48 and the straight portion 51 from the vicinity of the tip of the needle-like protrusion 23 but do not always have to penetrate the boundary therebetween. Even if the groove portions 54A and 54B do not penetrate the boundary, the compressed air between the sealing film 46 and the tapered portion 48 is allowed to flow out to the outside. In other words, any arrangement of the groove portions 54A and 54B or the ink introducing ports 24 can be set in the invention as long as the compressed air between the sealing film 46 and the tapered portion 48 is allowed to flow out to the outside of the ink introducing needles 21A and 21B through the groove portions 54A and 54B without allowing the air to enter the ink introducing ports 24 when the ink cartridge 7A is mounted and as long as the groove portions 54A and 54B extend along the breaking direction X of the sealing film 46 in the ink cartridge 7A. Moreover, the number of the groove portions 54A and 54B or the ink introducing ports 24 can also be arbitrarily set.

Embodiment 3

Figure 19A:
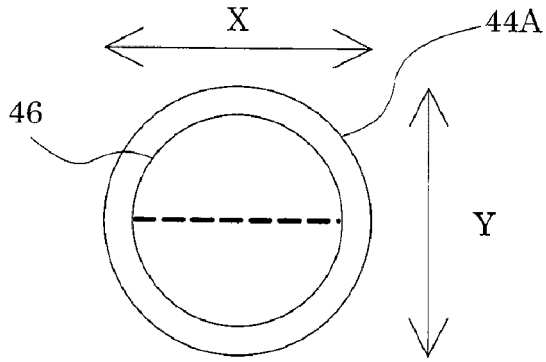
FIG. 19A is a plan view of a needle insertion slot.
Figure 19B:
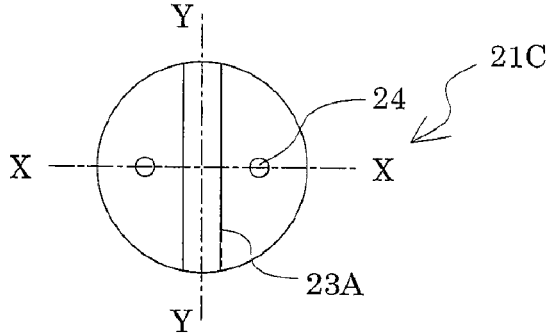
FIG. 19B is a plan view of an ink introducing needle.
Figure 19C:
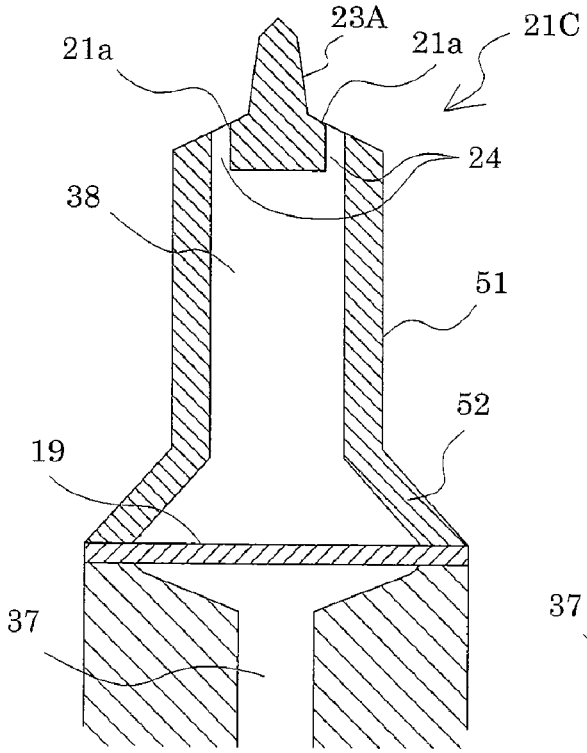
FIGS. 19C and 19D are cross-sectional views of the ink introducing needle.
Figure 19D:
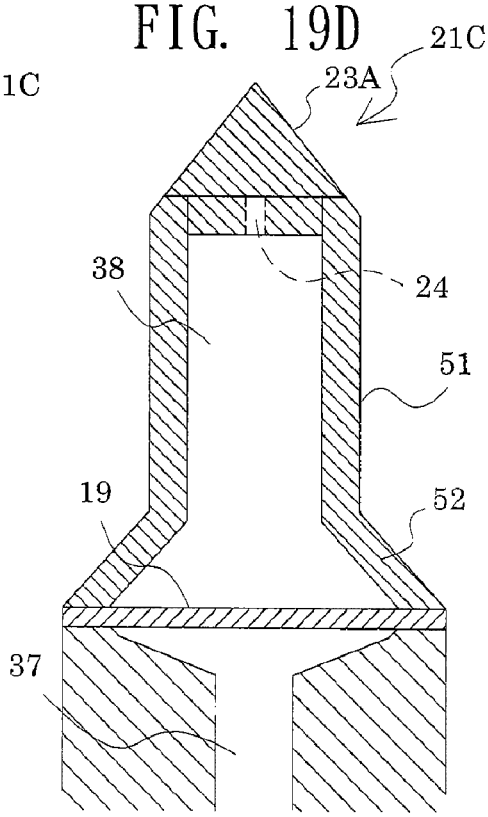

In Embodiments 1 and 2, the description was given of the ink introducing needles 21, 21A and 21B, each of which has the tapered tip, as the liquid introducing columnar body. However, the invention is not limited to such a shape. The liquid introducing columnar body may have a shape which enables the ink in the ink cartridge 7 or 7A to be introduced into the ink introducing path 38 by breaking the sealing film 46 in the ink cartridge 7 or 7A and being inserted into the needle insertion slot 44A. For example, a protrusion which protrudes toward the needle insertion slot 44A in the ink cartridge 7 or 7A may be provided. FIG. 19A is a plan view of the needle insertion slot in the ink cartridge. FIG. 19B is a plan view of an ink introducing needle. FIG. 19C is a cross-sectional view taken along the line X-X in FIG. 19B. FIG. 19D is a cross-sectional view taken along the line Y-Y in FIG. 19B. Hereinafter, the same parts as those in the ink-jet recording apparatuses according to Embodiments 1 and 2 will be denoted by the same reference numerals and repetitive description will be omitted.

As shown in FIGS. 19C and 19D, a protrusion 23A that protrudes toward the needle insertion slot 44A in the ink cartridge 7A is formed on a tip surface of an ink introducing needle 21C. As shown in FIG. 19B, a longitudinal direction of the protrusion 23A intersects with the breaking direction X of the sealing film 46. To be more specific, the protrusion 23A has an inclined surface in its longitudinal direction, which is inclined to bulge toward its center from a shoulder portion 21*a* continuous with a base of the protrusion 23A of the ink introducing needle 21C, as shown in FIG. 19C, in the breaking direction X (left and right direction in FIGS. 19B and 19C) of the sealing film 46 in the ink cartridge 7A. Meanwhile, the protrusion 23A has an inclined surface which is inclined to bulge toward its center from an end portion of the ink introducing needle 21C, as shown in FIG. 19D, in the rolling direction Y (up and down direction in FIG. 19B and left and right direction in FIG. 19D) which is perpendicular to the breaking direction X. Specifically, the protrusion 23A has a shape that is narrower in the breaking direction X than in the rolling direction Y and the longitudinal direction thereof is perpendicular to the breaking direction X.

Next, mounting of the ink cartridge 7A on the cartridge mounting parts 15' will be described. FIGS. 20A and 20C and FIGS. 21A and 21C are cross-sectional views when the ink cartridge is mounted on the ink introducing needles (the cartridge mounting parts). FIGS. 20B and 20D and FIGS. 21B and 21D are plan views of the ink introducing needle when viewed from the arrow A-A direction in FIGS. 20A and 20C and FIGS. 21A and 21C.

Figure 20A:
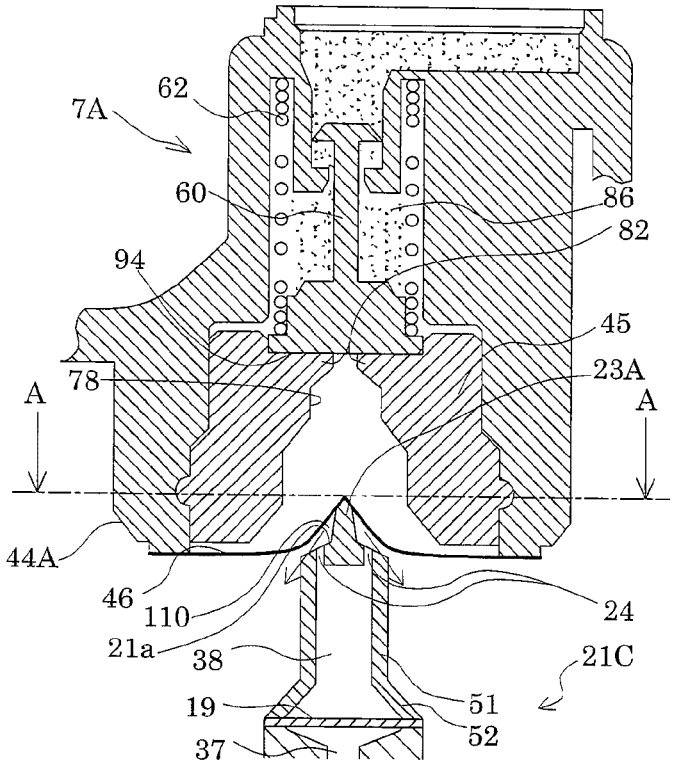
FIGS. 20A and 20C are cross-sectional views when an ink cartridge is mounted on the ink introducing needles.
Figure 20B:
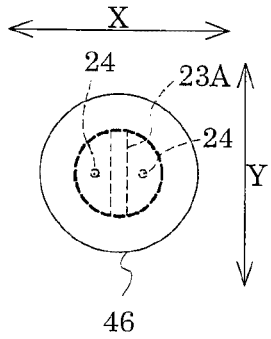
FIGS. 20B and 20D are plan views of the ink introducing needle when viewed from the arrow A-A direction in FIGS. 20A and 20C.

In the mounting of the ink cartridge 7A on the cartridge mounting parts 15', as shown in FIGS. 20A and 20B, the ink cartridge 7A is pushed downward from above the cartridge mounting parts 15' in a state of allowing each of the needle insertion slots 44A to face downward. In this event, the longitudinal direction of the protrusion 23A in the ink introducing needle 21C is perpendicular to the breaking direction X of the sealing film 46. The above pushing bends the sealing film 46 on the needle insertion slot 44A to adhere to the tip surface of the protrusion 23A. Meanwhile, the sealing film 46 does not adhere to the shoulder portion 21*a* and the straight portion 51 in the ink introducing needle 21C. Thus, an open space 110 is formed between the shoulder portion 21*a* in the ink introducing needle 21C and the sealing film 46.

Figure 20C:
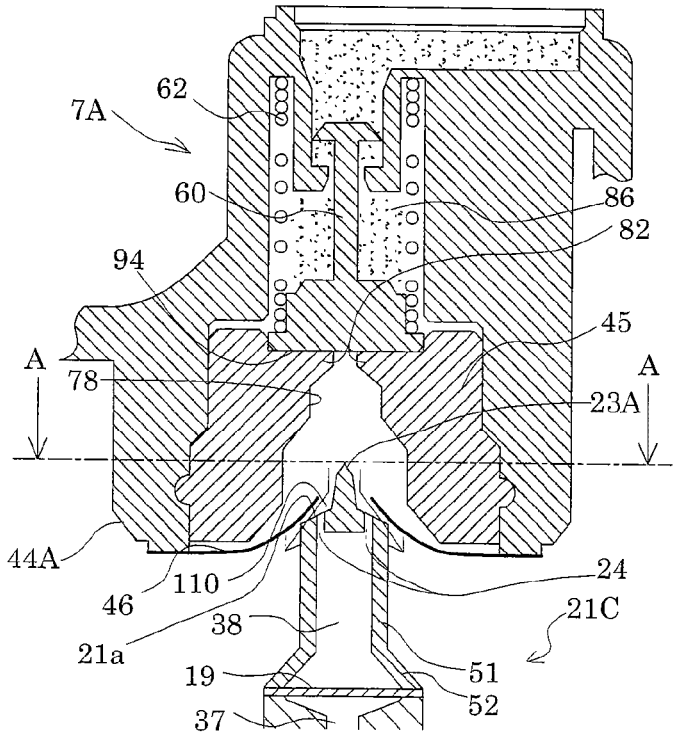
Figure 20D:
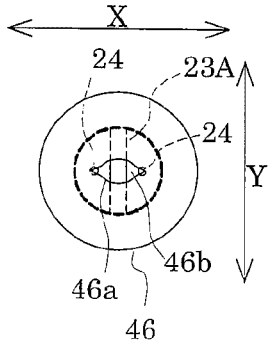
Figure 21A:
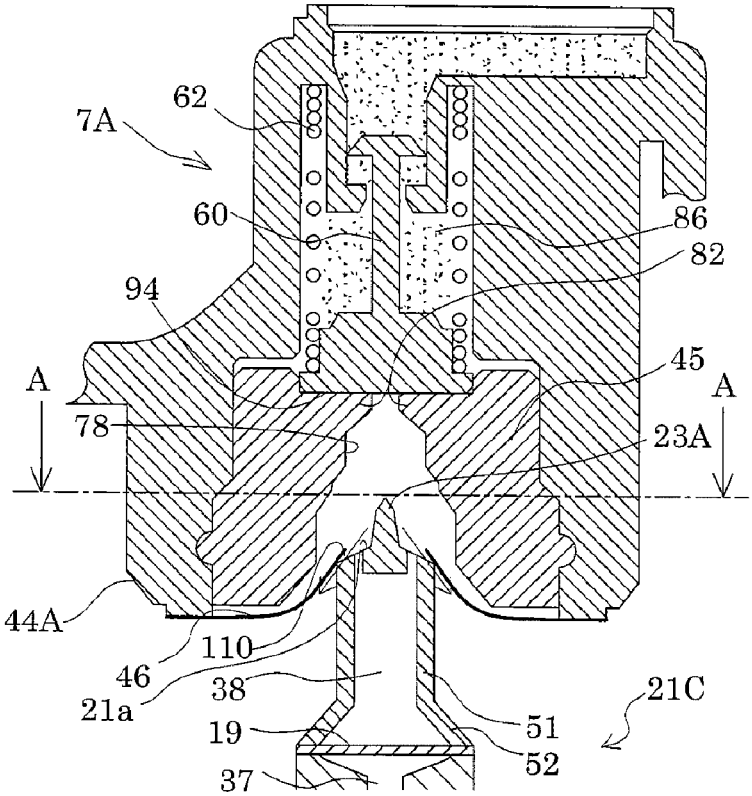
FIGS. 21A and 21C are cross-sectional views when the ink cartridge is mounted on the ink introducing needles.

When the ink cartridge 7A is pushed down to some extent toward the ink introducing needle 21C from the above state, the protrusion 23A of the ink introducing needle 21C breaks the sealing film 46, as shown in FIGS. 20C and 20D. In this event, the sealing film 46 is broken along the breaking direction X by the protrusion 23A. An opening portion 46*b* of a broken portion 46*a* that is a broken portion of the sealing film 46 is wide in the breaking direction X and narrow in the rolling direction Y. Moreover, as shown in FIGS. 21A and 21B, when the ink cartridge 7A is further pushed into the cartridge mounting parts 15', the opening of the broken portion 46*a* gets wider in the breaking direction X.

Figure 21B:
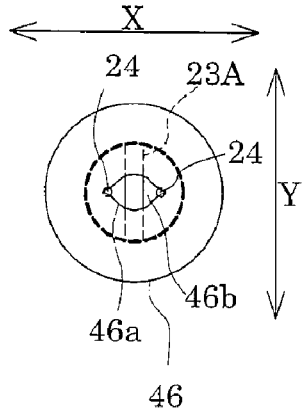
FIGS. 21B and 21D are plan views of the ink introducing needle when viewed from the arrow A-A direction in FIGS. 21A and 21C.
Figure 21C:
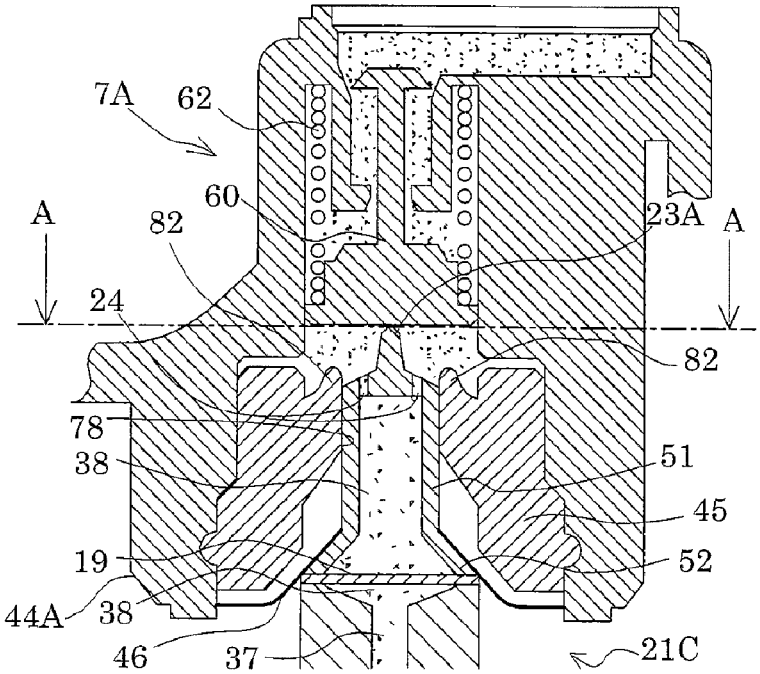
Figure 21D:
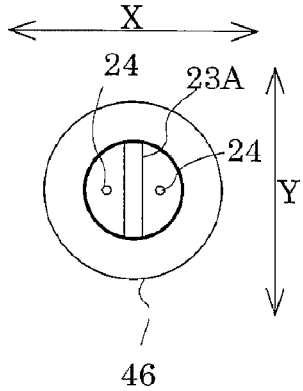

Lastly, as shown in FIGS. 21C and 21D, when the ink cartridge 7A is pushed down to the base of the ink introducing needle 21C, the ink introducing needle 21C breaks the sealing film 46 and is also set in a state where the protrusion 23A and a part of the straight portion 51 are inserted into the ink cartridge 7A (a mounted state of the ink cartridge 7A). After the straight portion 51 is fitted into the fitting portion 78 in the sealing member 45 and the protrusion 23A penetrates the pleat portion 82 in the sealing member 45, the protrusion 23A pushes open the valve body 60. Thus, the inside of the ink cartridge 7A and the ink introducing path 38 (the ink passage) are communicated with each other through the ink introducing ports 24. Accordingly, the ink is introduced into the pressure chambers 35 in the recording head 3.

Here, even if the sealing film 46 on the needle insertion slot 44A is flexed and adheres to the tip surface of the protrusion 23A in the ink introducing needle 21C when the ink cartridge 7A is mounted, the open space 110 is formed between the sealing film 46 and the shoulder portion 21*a* of the ink introducing needle 21C. Thus, as indicated by the arrows in FIG. 20A, air compressed between the sealing film 46 and the outer surface of the shoulder portion 21*a* is allowed to flow out to the outside to which the sealing film 46 does not adhere, to be more specific, to the outside from a boundary between a peripheral portion of the shoulder portion 21*a* and the straight portion 51 without allowing the air to enter the ink introducing needle 21C through the ink introducing ports 24.

Moreover, as shown in FIGS. 20D and 21B, during breaking of the sealing film 46 by the protrusion 23A, the broken portion 46*a* of the sealing film 46 gets wider in the breaking direction X than in the rolling direction Y. Meanwhile, the opening portion 46*b* is never blocked by the protrusion 23A since the longitudinal direction of the protrusion 23A is perpendicular to the breaking direction X. Therefore, the inside of the needle insertion slot 44A in the ink cartridge 7A can be communicated with the open space 110 through the opening portion 46*b*. As a result, the opening portion 46*b* and the open space 110 serve as a passage for discharging the air inside the needle insertion slot 44A to the outside, as indicated by the arrows in FIG. 20C and FIG. 21A. Particularly, in this embodiment, since the longitudinal direction of the protrusion 23A is perpendicular to the breaking direction X, a maximum area can be secured for the opening portion 46*b* when the sealing film 46 is broken. Thus, the air inside the needle insertion slot 44A can be most efficiently discharged.

Consequently, even if a pressure of the air inside the needle insertion slot 44A in the ink cartridge 7A is increased by bending the sealing film 46, the air having the increased pressure is also discharged to the outside through the opening portion 46*b* and the open space 110. Therefore, in the mounting of the ink cartridge 7A, the air to turn into bubbles can be prevented from entering the ink introducing needle 21C. Thus, compared with the conventional case, a frequency of execution of a cleaning operation for discharging the bubbles flowing into the ink introducing needle 21C (ink passage) to the outside can be reduced. As a result, ink consumption associated with the cleaning operation can be reduced.

Other Embodiment

Moreover, as described in the embodiments, all of the liquid introducing columnar bodies according to the invention are pointed toward the ink cartridges 7 and 7A, such as the needle-like protrusion 23 formed at the tip of the ink introducing needles 21, 21A and 21B or the protrusion 23A formed at the tip of the ink introducing needle 21C. However, the invention is not limited to such a shape. For example, the ink introducing needle may have a planar tip which comes into surface contact with the sealing film and groove portions may be provided in the planar tip portion. By providing the groove portions in the planar portion of the tip of the ink introducing needle, compressed air between the ink introducing needle and the sealing film can be discharged to the outside of the ink introducing needle through the groove portions when the ink introducing needle breaks the sealing film in the ink cartridge. Furthermore, the groove portions may extend up to an edge of the planar portion at the tip of the ink introducing needle. Moreover, the groove portions may be provided in the ink introducing needle along the breaking direction of the sealing film.

When the ink introducing needle having the configuration as described above is attached to the ink cartridge, even if the sealing film adheres to the planar portion, the compressed air between the sealing film and the planar portion is allowed to flow out to the outside through the groove portions without allowing the air to enter the ink introducing needle through the ink introducing ports. Moreover, the groove portions may continuously extend to the straight portion from the planar portion. Thus, even if the sealing film adheres to the entire planar portion of the ink introducing needle and the upper portion of the outer peripheral surface of the straight portion, the air between the sealing film and the planar portion can be surely allowed to flow out to the outside through the groove portions extending to the outer peripheral surface of the straight portion.

Moreover, in the ink introducing needle having the planar portion as described above, as in the case of the tip of the ink introducing needle shown in FIG. 10A, groove portions extending in a direction intersecting with the breaking direction X of the sealing film may be further provided (corresponding to FIG. 10A). Alternatively, a plurality of groove portions may be communicated with each other in the vicinity of the center of the planar portion (corresponding to FIGS. 10B and 10C). Moreover, as in the case of the ink introducing needles shown in FIGS. 10A and 10C, the ink introducing ports may be drilled in the planar portion rather than the groove portions (corresponding to FIGS. 10A and 10C). Alternatively, the ink introducing ports may be provided in the outer peripheral surface of the straight portion or inside the groove portions provided in the straight portion.

Furthermore, the invention is not limited to an on-carriage type having the ink cartridge 7 or 7A mounted on the carriage 4 as in each of the embodiments but is also applicable to an off-carriage type which supplies ink to the recording head 3 through an ink supply tube by mounting the ink cartridge 7 or 7A on a cartridge holder (a kind of liquid-storage-member mounting part) in a case body of the printer 1. Specifically, the configurations in the respective embodiments described above can also be applied to an ink introducing needle attached to the cartridge holder in the off-carriage type.

The invention has been described above by taking, as an example, the printer 1 that is a kind of liquid-jet apparatus. However, the invention can also be applied to other liquid-jet apparatuses having liquid introducing needles. The invention can also be applied to, for example: display manufacturing equipment for manufacturing color filters of a liquid crystal display and the like; electrode manufacturing equipment for forming electrodes of an organic EL (Electro Luminescence) display, a FED (Field Emission Display) and the like; chip manufacturing equipment for manufacturing a biochip (biochemical chip); and a micropipette for accurately supplying a minute amount of sample solution.

What is claimed is:

1. A liquid-jet apparatus comprising:

a liquid storage member in which a liquid is stored, and which has an outlet to be an outlet of the liquid;

a liquid-storage-member mounting part on which the liquid storage member is detachably mounted;

a liquid introducing columnar body which introduces the liquid inside the liquid storage member into a liquid passage therein from liquid introducing ports in a state of being inserted into the outlet of the liquid storage member mounted; and a liquid-jet head which can eject the liquid, which is introduced from the liquid introducing columnar body, from nozzle orifices in accordance with the operation of a pressure generator, wherein the liquid introducing columnar body includes a tip surface facing the outlet, and a straight portion formed continuously with the tip surface, and groove portions are provided in the tip surface of the liquid introducing columnar body, wherein the liquid introducing ports are drilled to have openings inside the corresponding groove portions.

2. The liquid-jet apparatus according to claim 1, wherein the groove portions penetrate a boundary between the tip surface and the straight portion.

3. The liquid-jet apparatus according to claim 1, wherein the groove portions continuously extend to the middle of the straight portion from the tip surface.

4. The liquid-jet apparatus according to claim 1, wherein the liquid introducing columnar body includes a needle-like protrusion having a tapered portion whose diameter is gradually increased toward its base from its tip, and the tip surface is a tapered surface of the needle-like protrusion.

5. The liquid-jet apparatus according to claim 1, wherein the outlet of the liquid storage member is sealed by a sealing member to be broken along one direction, and the groove portions in the liquid introducing columnar body are formed along the direction in which the sealing member is to be broken.

6. A liquid-jet apparatus comprising:

a liquid storage member in which a liquid is stored, and which has an outlet to be an outlet of the liquid;

a liquid-storage-member mounting part on which the liquid storage member is detachably mounted;

a liquid introducing columnar body which introduces the liquid inside the liquid storage member into a liquid passage therein from liquid introducing ports in a state of being inserted into the outlet of the liquid storage member mounted; and a liquid-jet head which can eject the liquid, which is introduced from the liquid introducing columnar body, from nozzle orifices in accordance with the operation of a pressure generator, wherein the outlet of the liquid storage member is sealed by a sealing member to be broken along one direction, a protrusion is formed on a tip surface of the liquid introducing columnar body, the tip surface facing the sealing member, the protrusion has its longitudinal direction intersecting with the direction in which the sealing member is to be broken, groove portions are provided in the tip surface of the liquid introducing columnar body, and wherein the liquid introducing ports are drilled to have openings inside the corresponding groove portions.

* * * * *